US010779690B2

(12) United States Patent
Aoyama et al.

(10) Patent No.: US 10,779,690 B2
(45) Date of Patent: Sep. 22, 2020

(54) FOAMING DISPENSER

(71) Applicant: KAO CORPORATION, Tokyo (JP)

(72) Inventors: Ryohei Aoyama, Sumida-ku (JP); Chris King, Cincinnati, OH (US); Noboru Yashima, Sumida-ku (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 16/230,066

(22) Filed: Dec. 21, 2018

(65) Prior Publication Data

US 2019/0191936 A1 Jun. 27, 2019

Related U.S. Application Data

(60) Provisional application No. 62/610,752, filed on Dec. 27, 2017.

(51) Int. Cl.

| | |
|---|---|
| ***A47K 5/16*** | (2006.01) |
| ***B65D 47/06*** | (2006.01) |
| ***B05B 11/04*** | (2006.01) |
| ***B05B 7/00*** | (2006.01) |
| ***B05B 11/00*** | (2006.01) |
| ***A47K 5/14*** | (2006.01) |
| ***A47K 5/12*** | (2006.01) |

(52) U.S. Cl.

CPC ..... *A47K 5/16* (2013.01); *A47K 5/1205* (2013.01); *A47K 5/14* (2013.01); *B05B 7/0037* (2013.01); *B05B 11/047* (2013.01); *B05B 11/3087* (2013.01); *B65D 47/06* (2013.01)

(58) Field of Classification Search

CPC ..... A47K 5/14; A47K 5/16; B05B 11/3087
See application file for complete search history.

(56) References Cited

U.S. PATENT DOCUMENTS

| | | | | |
|---|---|---|---|---|
| 2005/0115988 | A1 | 6/2005 | Law et al. | |
| 2012/0241477 | A1 | 9/2012 | Uehira et al. | |
| 2013/0068794 | A1* | 3/2013 | Kodama | B05B 11/047 222/190 |
| 2017/0265691 | A1 | 9/2017 | Ophardt et al. | |
| 2018/0154379 | A1* | 6/2018 | Knight | B05B 11/3052 |

FOREIGN PATENT DOCUMENTS

| | | | |
|---|---|---|---|
| JP | 2012-110799 | A | 6/2012 |
| WO | WO 2011/152375 | A1 | 12/2011 |
| WO | WO 2016/193764 | A1 | 12/2016 |

OTHER PUBLICATIONS

International Search Report and Written Opinion dated Mar. 22, 2019 in PCT/US 18/67584, 15 pages.

* cited by examiner

*Primary Examiner* — J C Jacyna
(74) *Attorney, Agent, or Firm* — Oblon, McClelland, Maier & Neustadt, L.L.P.

(57) ABSTRACT

A foaming dispenser has a mixing chamber configured to mix a liquid and a gas to foam the liquid, a first liquid passage configured to supply the liquid to the mixing chamber, and a discharge opening configured to discharge the foamed liquid, the mixing chamber includes a plurality of second liquid passages branching and extending from the first liquid passage, a liquid passage meeting where one second liquid passage meets another second liquid passage, a gas passage configured to supply the gas to the liquid flowing from the plurality of second liquid passages to the liquid passage meeting, and a hole that is provided on a downstream side of the gas passage and communicates with the discharge opening.

16 Claims, 16 Drawing Sheets

FOAMING DISPENSER

CROSS REFERENCE TO RELATED APPLICATION(S)

This application is based upon and claims benefit of priority from U.S. Provisional Patent Application 62/610,752, filed on Dec. 27, 2017, the entire contents of which are incorporated herein by reference.

BACKGROUND

The present invention relates to a foaming dispenser.

Examples of a foaming dispenser that foams and discharges liquid include a foaming dispenser container described in WO 2011/152375. The foaming dispenser container of WO 2011/152375 is capable of mixing liquid and gas to generate foamy liquid, and discharging the foamy liquid to the outside of the foaming dispenser container.

CITATION LIST (Patent Literature 1) WO 2011/152375

SUMMARY

The present invention relates to a foaming dispenser capable of mixing liquid and gas to generate suitable foamy liquid. In detail, the present invention relates to a foaming dispenser capable of obtaining suitable foamy liquid, by making it possible to mix liquid and gas sufficiently. Furthermore, the present invention relates to a foaming dispenser capable of generating suitable foamy liquid even from liquid that contains particles etc. and thus has been unable to be foamed.

The present invention relates to a foaming dispenser having a mixing chamber configured to mix a liquid and a gas to foam the liquid, a first liquid passage configured to supply the liquid to the mixing chamber, and a discharge opening configured to discharge the foamed liquid. Furthermore, the mixing chamber includes a plurality of second liquid passages branching and extending from the first liquid passage, a liquid passage meeting where one second liquid passage meets another second liquid passage, a gas passage configured to supply the gas to the liquid flowing from the plurality of second liquid passages to the liquid passage meeting, and a hole that is provided on a downstream side of the gas passage and communicates with the discharge opening.

DETAILED DESCRIPTION OF THE EMBODIMENT(S)

Figure 1:
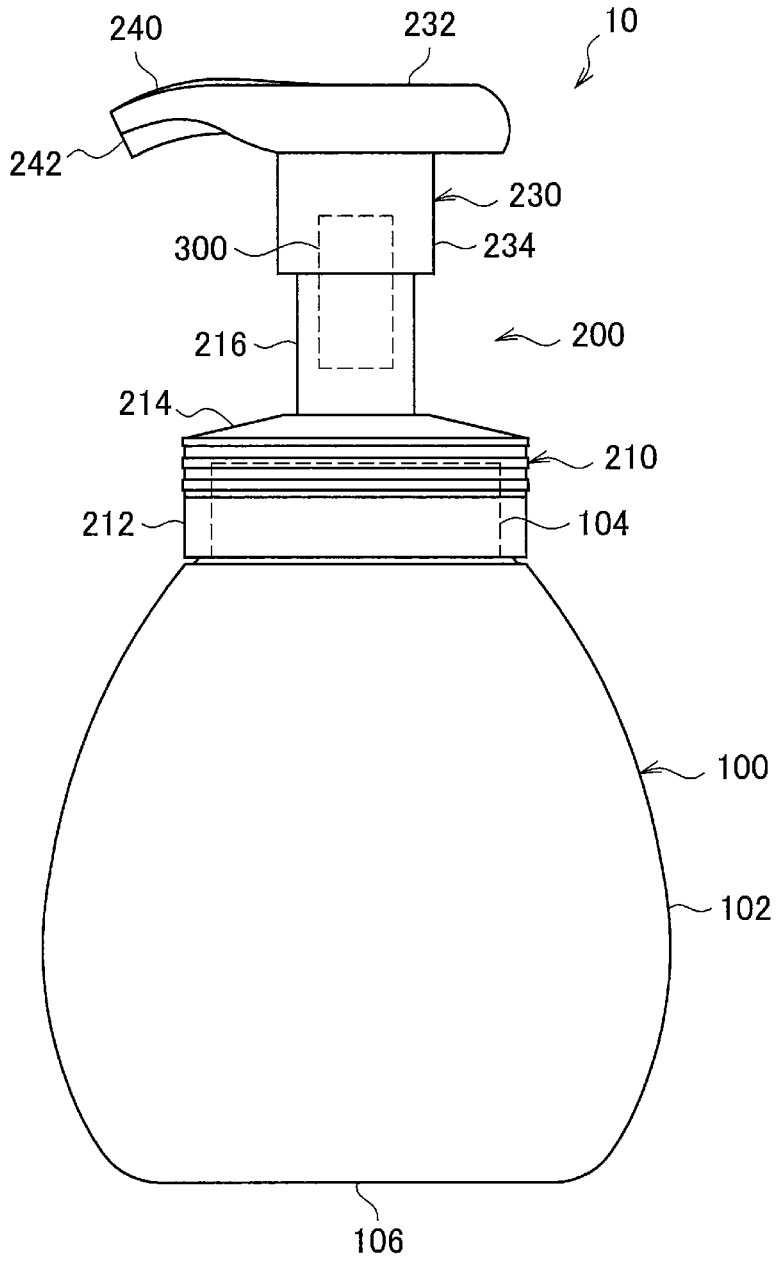
FIG. 1 is an explanatory diagram illustrating the appearance of a foaming dispenser container 10 according to an embodiment of the present invention.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted. Note that, in this description and the drawings, similar structural elements of different embodiments are sometimes distinguished from each other using different alphabets after the same reference sign. However, when there is no need in particular to distinguish similar structural elements, the same reference sign alone is attached.

The drawings referred to in the following description are intended to assist the description of embodiments of the present invention and understanding thereof, and for easy understanding, shapes, dimensions, ratios, etc. illustrated in the drawings are different from actual ones in some cases. In addition, description about a specific shape in the following description does not only mean a case of geometrically having the shape, but means that shapes similar to the shape and having differences to an extent allowable in manufacture and use of a foaming dispenser container are also included. For example, in the case where an expression of "circular" or "substantially circular" is used in the following description, the expression also means a shape similar to a perfect circle, such as an ellipse, without being limited to a perfect circle. Furthermore, "substantially the same" used for specific lengths and shapes in the following description does not only mean a case of completely matching mathematically or geometrically, but means that values and similar shapes having differences to an extent allowable in manufacture and use of a foaming dispenser container are also included.

In addition, in the following description, a vertical direction is defined with respect to a foaming dispenser container according to an embodiment of the present invention. In detail, the vertical direction in the following description means a vertical direction when, in a foaming dispenser container described later, a container body is disposed on the lower side and a foaming dispenser cap on the upper side. However, the vertical direction is sometimes different from a vertical direction of a foaming dispenser container and an element (component) constituting the foaming dispenser container in manufacture and use of a foaming dispenser container 10. Furthermore, in the following description, "upstream" and "downstream" mean relative positions of flow of liquid or gas; in detail, in regard to flow of liquid and gas, a position close to a starting point of the flow is called an upstream side, and a position relatively far from the starting point as compared with the "upstream" side is called a "downstream" side.

Furthermore, in the following description, foamy liquid means liquid in a state of including a plurality of bubbles that are spherical or shaped like spheres by the liquid involving the bubbles. Therefore, in the following description, a size (specifically, a diameter of the sphere, etc.) of a bubble included in foamy liquid, distribution density of bubbles, etc. are not particularly limited, and the bubble size and distribution density change in accordance with uses of the liquid, for example.

<<Schematic Configuration of Foaming Dispenser Container 10>>

The foaming dispenser container 10 according to an embodiment of the present invention is a container capable of mixing liquid stored in a container body 100 described later with gas taken in from the outside of the container body 100 to make the liquid foamy, and discharging the foamy liquid to the outside of the foaming dispenser container 10. First, a schematic configuration of the foaming dispenser container 10 according to the embodiment of the present invention will be described with reference to FIG. 1. FIG. 1 is an explanatory diagram illustrating the appearance of the foaming dispenser container 10.

As illustrated in FIG. 1, the foaming dispenser container 10 according to the present embodiment mainly includes the container body 100 in which liquid is stored and a foaming dispenser cap 200 that is detachably attached to the container body 100. An overview of each part of the foaming dispenser container 10 is described below.

Note that the foaming dispenser container 10 described below is a container what is called a pump foamer that has a manual pump and can make liquid foamy and discharge the foamy liquid by a head 230 of the foaming dispenser cap 200, which is described later, being pushed down by a user's finger etc. That is, in the following description, the foaming dispenser container 10 is described as a pump-foamer-type container. However, the foaming dispenser container 10 according to the embodiment of the present invention is not limited to a pump-foamer-type container. For example, the foaming dispenser container 10 may be a container what is called a squeeze foamer that can make liquid foamy and discharge the foamy liquid by the container body 100 being squeezed by the user.

(Container Body 100)

The container body 100 has a space in which liquid can be stored. For example, as illustrated in FIG. 1, the container body 100 includes a cylindrical (circular tubular) barrel 102, a cylindrical neck 104 connected to the upper side of the barrel 102, and a bottom 106 blocking a lower end of the barrel 102. In detail, the barrel 102 can have a space for storing liquid by its lower end being blocked by the bottom 106. Furthermore, the neck 104 is provided with an opening, and part of the foaming dispenser cap 200 described later can be inserted into the opening. Note that in the present embodiment, a shape of the container body 100 is not limited to the shape illustrated in FIG. 1, and may be another shape.

Liquid to be stored in the container body 100 is, for example, any of various liquids to be used in a foamy form, such as a face wash, hand soap, body soap, a cleanser, various detergents (e.g., for dishes or for baths), a hairdressing, shaving cream, skin cosmetics (e.g., foundation or a serum), a hair dye, and an antiseptic, and is not particularly limited. Furthermore, viscosity of the liquid is not particularly limited, but at 25° C., for example, is preferably 2 centipoise (cP) or more, preferably equal to or greater than 10 cP and equal to or less than 20000 cP; 20 cP or more is further preferable and 30 cP or more is still further preferable, and 10000 cP or less is further preferable and 2000 cP or less is still further preferable. Note that the viscosity of the liquid can be measured using a B-type viscometer, for example. Note that as measurement conditions in measuring viscosity, the type of rotor, rotational speed, and rotation time defined on the basis of a viscosity level for each viscometer can be selected as appropriate.

In addition, liquid to be stored in the container body 100 can contain particles or powder (fine particles). The particles or powder may be, besides a solid such as an exfoliator, particles of solid fat or oil droplets (emulsion). Furthermore, as the particles or powder, one or more types of particles, fine particles, or additive selected from particles, fine particles, or various additives such as solid polymer particles, wax, an ultraviolet scattering agent, solid oil particles, an abrasive, silica, or an organic additive, may be contained. A particle size of such particles etc. is preferably equal to or greater than 0.001 μm and equal to or less than 1000 μm; 0.1 μm or more is further preferable and 0.5 μm or more is still further preferable, and 700 μm or less is further preferable and 500 μm or less is still further preferable. Note that the particle size of the particles etc. means a diameter of a sphere constituting the particles etc. A value of the particle size can be obtained by, for example, measuring distribution of particle sizes of particles by a laser diffraction scattering method using a laser scattering particle distribution analyzer LA-920 from Horiba, Ltd.

(Foaming Dispenser Cap 200)

As illustrated in FIG. 1, the foaming dispenser cap 200 can be detachably attached to the neck 104 of the container body 100 described above by a fixing method such as screwing. The foaming dispenser cap 200 mainly includes a cap member 210 configured to be attached to the neck 104, a cylinder 220 fixed to the cap member 210 and constituting a liquid supply unit and a gas supply unit described later, and a head 230 that discharges foamy liquid to the outside of the foaming dispenser container 10.

In detail, the cap member 210 includes a cylindrical attachment part 212, and the entire foaming dispenser cap 200 can be attached to the container body 100 by the attachment part 212 being screwed, for example, with the neck 104. In other words, the foaming dispenser cap 200 blocks the opening of the neck 104 by the foaming dispenser cap 200 being attached to the neck 104. Note that the attachment part 212 may have a double-wall tube structure, and in such a case, an inner tube of the attachment part 212 is screwed, for example, with the neck 104. Furthermore, the cap member 210 includes an annular blocking part 214 blocking an upper end part of the attachment part 212, and a standing tube 216 standing upward from a central part of the annular blocking part 214 (a central part in planar view of the annular blocking part 214). The standing tube 216 has a cylindrical shape having a smaller diameter than the attachment part 212, and part of the cylinder 220 described later is inserted into the standing tube 216.

Furthermore, the cylinder 220 includes a foamer mechanism (mixing chamber) 300 that mixes liquid and gas to make the liquid foamy, a liquid supply unit configured to supply liquid stored in the container body 100 to the foamer mechanism (mixing chamber) 300, and a gas supply unit that takes in gas from the outside of the foaming dispenser container 10 and supplies the gas to the foamer mechanism 300. In detail, the liquid supply unit is a liquid cylinder constituting a liquid pump, for example, and applies pressure to liquid in a liquid pump chamber 280 (liquid chamber) described later (see FIG. 2) to supply the liquid to the foamer mechanism 300. In addition, the gas supply unit is a gas cylinder constituting a gas pump, for example, and applies pressure to gas in a gas pump chamber 260 (gas chamber) described later (see FIG. 2) to supply the gas to the foamer mechanism 300. Note that details of the liquid supply unit, the gas supply unit, and the foamer mechanism 300 are described later with reference to other drawings. In addition, an upper end of the cylinder 220 is blocked by the head 230 described later.

Note that in the following description, the gas to be mixed with liquid in the foamer mechanism 300 means air (outside air) including nitrogen, oxygen, carbon dioxide, etc. taken in from the outside to the inside of the foaming dispenser container 10. However, in the present embodiment, the gas is not limited to air, and for example, the gas may be gas including any of various gaseous components stored in advance in the container body 100 etc. of the foaming dispenser container 10.

As illustrated in FIG. 1, the head 230 includes a nozzle 240 provided as an object integrated with the head 230. Furthermore, a tip of the nozzle 240 is provided with a discharge opening 242. An internal space of the nozzle 240 communicates with the foamer mechanism 300, and liquid foamed in the foamer mechanism 300 can be discharged to the outside of the foaming dispenser container 10 from the discharge opening 242.

Furthermore, the head 230 is configured to be vertically movable. In detail, the head 230 includes an operating part 232 that undergoes push-down operation by the user's finger etc. In addition, the nozzle 240 is provided to project from the operating part 232, as illustrated in FIG. 1. Specifically, in the case where push-down operation is performed on the operating part 232, and the head 230 is pushed down relatively to the attachment part 212, the liquid supply unit applies pressure to liquid in the liquid pump chamber 280 (see FIG. 2) to supply the liquid to the foamer mechanism 300, and the gas supply unit applies pressure to gas in the gas pump chamber 260 (see FIG. 2) to supply the gas to the foamer mechanism 300. In addition, the head 230 includes a tubular part 234 drooping downward from the operating part 232.

<<Detailed Configuration of Foaming Dispenser Cap 200>>

Figure 2:
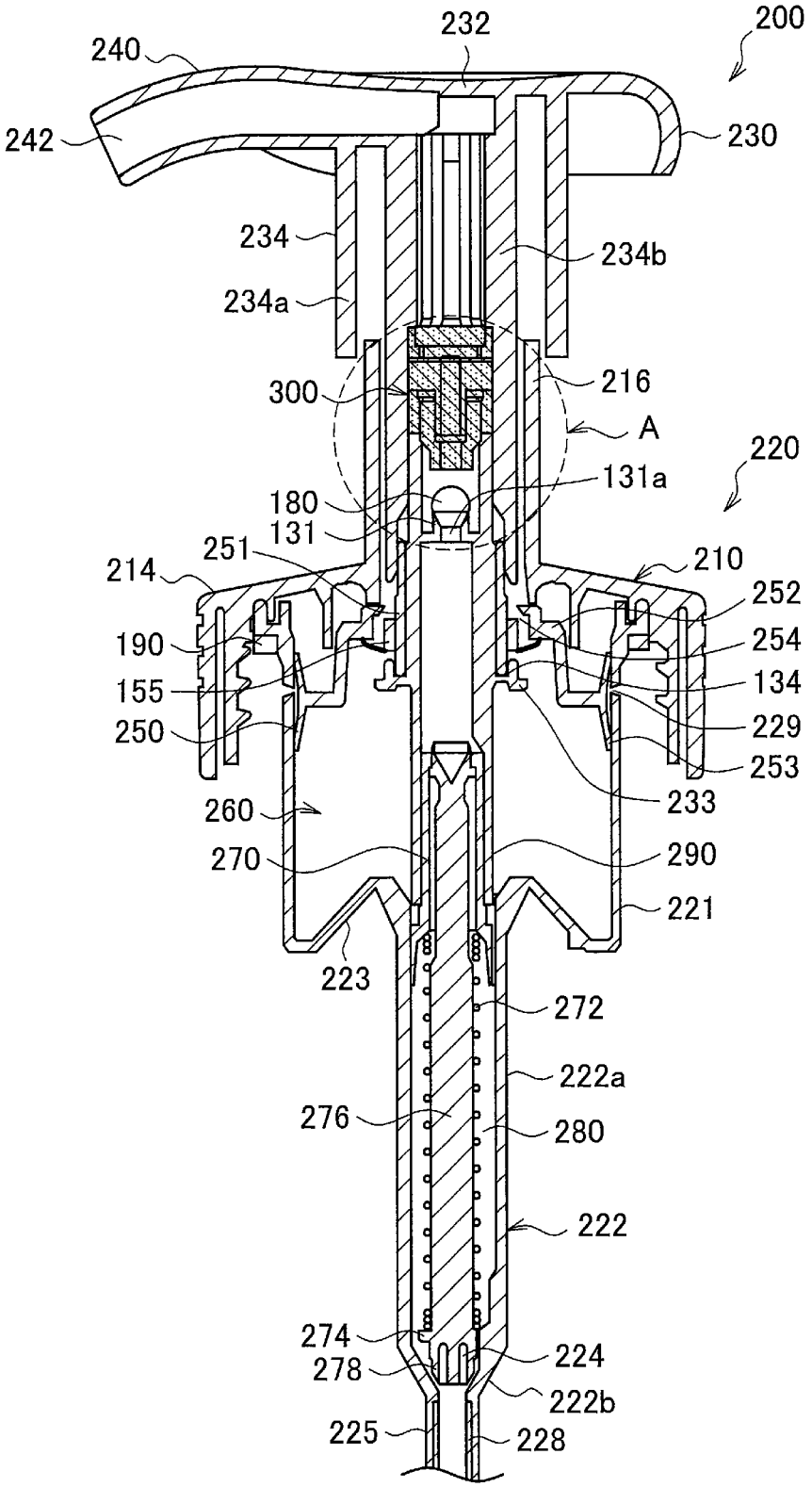
FIG. 2 is an explanatory diagram illustrating a side cross-section of a foaming dispenser cap 200 according to an embodiment of the present invention.
Figure 3:
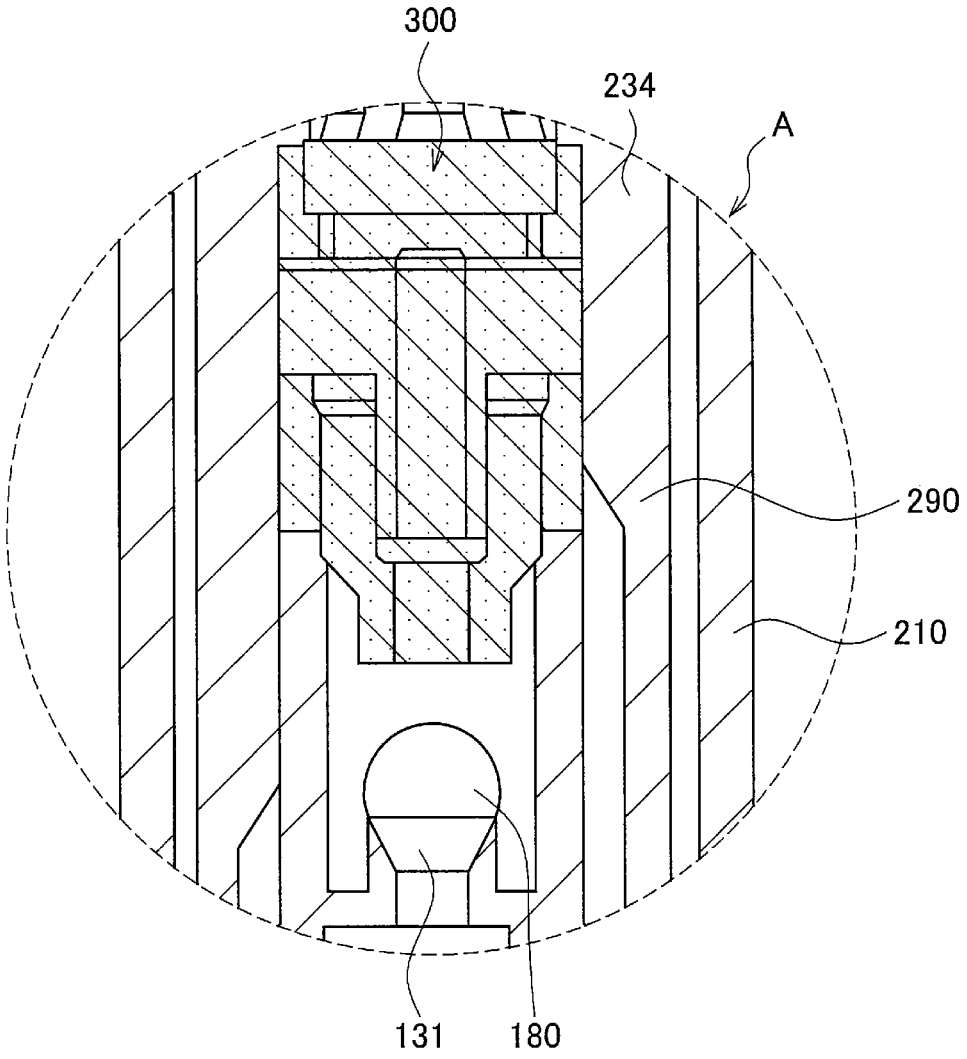
FIG. 3 is an enlarged view of a region A indicated by a broken line in FIG. 2.

Next, a detailed configuration of the foaming dispenser cap 200 described above is described with reference to FIGS. 2 and 3. FIG. 2 is an explanatory diagram illustrating a side cross-section of the foaming dispenser cap 200 according to the embodiment of the present invention. In addition, FIG. 3 is an enlarged view of a region A indicated by a broken line in FIG. 2. As described above, the foaming dispenser cap 200 according to the present embodiment mainly includes the head 230, the cylinder 220, and the cap member 210. Furthermore, the foaming dispenser cap 200 includes a piston guide 290 as illustrated in FIG. 2. A detailed configuration of each part of the foaming dispenser cap 200 is described below.

(Head 230)

As described above, the head 230 includes the operating part 232, and the tubular part 234 drooping downward from the operating part 232. In detail, the tubular part 234 is indirectly supported by the cylinder 220, the piston guide 290 described later, a coil spring 272, etc. The head 230 can be pushed down (move down) within a predetermined range against biasing by the coil spring 272. Specifically, in a state where push-down operation is cancelled, the head 230 moves up relatively to the cap member 210 along a vertical direction in accordance with biasing by the coil spring 272, and moves to an upper stop point. On the other hand, when the user performs push-down operation on the head 230 (in detail, the operating part 232) against biasing by the coil spring 272, the head 230 moves down relatively to the cap member 210. In detail, as illustrated in FIG. 2, the tubular part 234 has a double-wall tube structure, and includes an outer tube 234*a* and an inner tube 234*b*. In the vertical movement of the head 230, the standing tube 216 of the cap member 210 can move in the vertical direction while ensuring a narrow-width passage that enables air suction between the outer tube 234*a* and the inner tube 234*b*.

(Foamer Mechanism 300)

As described above, the foamer mechanism 300 is a mechanism configured to mix liquid and gas to make the liquid foamy, and is accommodated in the inner tube 234*b* of the tubular part 234 of the head 230, as illustrated in FIGS. 2 and 3. As described above, the upper side of the foamer mechanism 300 communicates with the internal space of the nozzle 240 of the head 230; hence, liquid foamed in the foamer mechanism 300 can be discharged to the outside of the foaming dispenser container 10 via the discharge opening 242 of the nozzle 240. On the other hand, the lower side of the foamer mechanism 300 faces a non-return valve that is constituted by a ball valve 180 and a valve seat 131 provided inside the piston guide 290 described later and allows liquid supply to the foamer mechanism 300. Therefore, the foamer mechanism 300 can receive supply of liquid from the liquid supply unit located below the ball valve 180, and prevent return of liquid from the foamer mechanism 300 to the liquid supply unit, with the vertical movement of the ball valve 180 of the non-return valve. Note that details of the foamer mechanism 300 according to the embodiment of the present invention will be described later.

(Piston Guide 290)

The piston guide 290 is a cylindrical member located below the above-described foamer mechanism 300 and extending long along the vertical direction, and is fixed to the head 230. A liquid piston 270 described later is fixed to the head 230 via the piston guide 290. Furthermore, the head 230, the piston guide 290, and the liquid piston 270 can integrally move along the vertical direction. In addition, the cylindrical valve seat 131 is formed inside the upper side of the piston guide 290, and the ball valve 180 is disposed on the valve seat 131. The ball valve 180 is held to be vertically movable between a lower end of the foamer mechanism 300 and the valve seat 131. Furthermore, at the center of the valve seat 131, a through hole 131*a* that communicates with below the valve seat 131 is provided. That is, the ball valve 180 and the valve seat 131 constitute the non-return valve, and the non-return valve supplies liquid to the foamer mechanism 300 from below the valve seat 131 with the vertical movement of the ball valve 180.

In addition, a gas piston 250 described later is fitted onto the piston guide 290 in a state of being movably inserted, and the gas piston 250 can move along the vertical direction relatively to the piston guide 290. In addition, a central part of the piston guide 290 in the vertical direction is provided with a flange 233, and an upper surface of the flange 233 is provided with a circular annular (doughnut-shaped) valve-constituting groove 134. Furthermore, a tubular part 251 of the gas piston 250 described later is fitted onto an upper part of the piston guide 290 in a state of being movably inserted. The valve-constituting groove 134 and a lower end part of the tubular part 251 of the gas piston 250 constitute a gas exhaust valve. In more detail, an outer circumferential surface of a portion of the piston guide 290 onto which the tubular part 251 is fitted is provided with a plurality of passage-constituting grooves (not illustrated) each extending along the vertical direction. Gaps provided between these passage-constituting grooves and an inner circumferential surface of the tubular part 251 of the gas piston 250 constitute gas passages through which gas that flows out from the gas pump chamber 260 (gas chamber) described later via the gas exhaust valve flows upward.

(Liquid Supply Unit and Gas Supply Unit)

Furthermore, in the foaming dispenser cap 200 according to the present embodiment, the liquid supply unit and the gas supply unit are provided inside the cap member 210 and the cylinder 220, as illustrated in FIG. 2.

In detail, the cylinder 220 includes, as the gas supply unit, a cylindrical gas cylinder mechanism 221 fixed to the lower surface side of the annular blocking part 214 of the cap member 210. In addition, the cylinder 220 includes, as the liquid supply unit, a liquid cylinder mechanism 222 provided below the gas cylinder mechanism 221. Furthermore, the cylinder 220 includes an annular coupling part 223 that couples the gas cylinder mechanism 221 and the liquid cylinder mechanism 222. More specifically, the liquid cylinder mechanism 222 is provided to droop from the gas cylinder mechanism 221, and has a cylindrical shape having a smaller diameter than the gas cylinder mechanism 221. Furthermore, the annular coupling part 223 couples a lower end of the gas cylinder mechanism 221 and an upper end of the liquid cylinder mechanism 222 to each other. Note that in the case where the entire foaming dispenser cap 200 is viewed from above, the gas cylinder mechanism 221, the liquid cylinder mechanism 222, the cylinder 220, and the cap member 210 are disposed in a manner that their central axes exist on the same axis.

—Gas Cylinder Mechanism 221—

An upper end part of the gas cylinder mechanism 221 is fixed to the annular blocking part 214 by being fitted to the lower surface side of the annular blocking part 214. Furthermore, the gas cylinder mechanism 221 includes the gas piston 250. A space between the gas piston 250 and the annular coupling part 223 in the gas cylinder mechanism 221 is referred to as the gas pump chamber 260 below, and gas can be reserved in the gas pump chamber 260. In addition, a volume of the gas pump chamber 260 can expand and contract with the vertical movement of the gas piston 250.

The gas piston 250 includes the tubular part 251 having a cylindrical shape and fitted onto a central part of the piston guide 290 in the vertical direction in a state of being movably inserted, and a piston 252 jutting outward from the tubular part 251 in a radial direction. A circumferential edge of the piston 252 is provided with an outer circumferential ring 253. The outer circumferential ring 253 is circularly in airtight contact with an inner circumferential surface of the gas cylinder mechanism 221, and can slide with respect to the inner circumferential surface of the gas cylinder mechanism 221 when the gas piston 250 moves vertically. Note that a lower limit position of relative movement of the tubular part 251 with respect to the piston guide 290 is a position where the lower end part of the tubular part 251 meets the valve-constituting groove 134 and the gas exhaust valve enters a closed state. On the other hand, an inner circumferential surface of a lower end part of the tubular part 234 of the head 230 is provided with a regulation mechanism (not illustrated) that regulates upward movement of the tubular part 251 with respect to the piston guide 290 and the tubular part 234. Therefore, an upper limit position of relative movement of the tubular part 251 with respect to the piston guide 290 is a position where movement of an upper end part of the tubular part 251 is regulated by the regulation mechanism after the gas exhaust valve enters an open state by the lower end part of the tubular part 251 separating from the valve-constituting groove 134. Furthermore, a portion of the piston 252 near the tubular part 251 is provided with a plurality of suction openings 254 penetrating the piston 252 along the vertical direction.

In addition, a circular annular suction valve member 155 is fitted onto the lower side of the tubular part 251 of the gas piston 250. The suction valve member 155 includes a valve body that is an annular membrane jutting outward in the radial direction. The valve body of the suction valve member 155 and the piston 252 constitute a gas suction valve. In detail, when the head 230 moves down, that is, when the gas pump chamber 260 contracts, the valve body of the suction valve member 155 comes into close contact with the piston 252 and thereby the suction openings 254 are blocked. On the other hand, when the head 230 moves up, that is, when the gas pump chamber 260 expands, air pressure in the gas pump chamber 260 decreases, so that the valve body of the suction valve member 155 separates from the piston 252 and the suction openings 254 are opened. Then, gas outside the foaming dispenser container 10 is taken into the gas pump chamber 260 via a gap located between an upper end of the standing tube 216 and the tubular part 234.

Furthermore, the gas cylinder mechanism 221 is provided with a through hole 229 that penetrates between the inside and outside of the gas cylinder mechanism 221. In a state where the head 230 is not pushed down and the head 230 is stopped above, the through hole 229 is blocked by the outer circumferential ring 253 of the gas piston 250. Furthermore, in the case where the head 230 is pushed down and the state where the through hole 229 is blocked by the outer circumferential ring 253 transitions to an unblocked state, gas outside the foaming dispenser container 10 flows into the container body 100 via the gap located between the upper end of the standing tube 216 and the tubular part 234, and the through hole 229. By the gas thus flowing in, a space (gas) located above a liquid surface of liquid in the container body 100 has the same air pressure as atmospheric pressure.

Note that an operation when the gas cylinder mechanism 221 supplies liquid to the foamer mechanism 300 in the present embodiment will be described later.

—Liquid Cylinder Mechanism 222—

The liquid cylinder mechanism 222 includes the liquid piston 270. In the following description, a space provided between the non-return valve constituted by the ball valve 180 and the valve seat 131 and a liquid suction valve described later in the liquid cylinder mechanism 222 is referred to as the liquid pump chamber 280 (liquid chamber). The liquid pump chamber 280 can reserve liquid, and a volume of the liquid pump chamber 280 can expand and contract with the vertical movement of the liquid piston 270 and the piston guide 290.

In detail, the liquid piston 270 has a cylindrical (circular tubular) shape. The liquid piston 270 can be fixed to the piston guide 290 by a lower end part of the piston guide 290 being inserted to an upper end part of the liquid piston 270. In addition, a straight part 222*a* of the liquid cylinder mechanism 222 is provided below a lower end of the liquid piston 270.

Furthermore, as illustrated in FIG. 2, the liquid cylinder mechanism 222 includes a poppet 276 that is a stick member extending along the vertical direction. The poppet 276 penetrates the liquid piston 270, and is inserted through the inside of the piston guide 290 to the inside of the liquid cylinder mechanism 222. The poppet 276 can move along the vertical direction relatively to the liquid piston 270. In addition, a lower end part of the poppet 276 constitutes a valve body 278. A lower surface of the valve body 278 can come into liquid-tight close contact with a valve seat 224 described later. The valve body 278 and the valve seat 224 constitute a liquid suction valve. In addition, an upper end part of the valve body 278 is provided with a spring bearing 274 that undergoes downward biasing from the coil spring 272 described later.

In addition, the liquid cylinder mechanism 222 includes the coil spring 272, and the coil spring 272 is fitted onto an intermediate part (in detail, an intermediate part in the vertical direction) of the poppet 276 in a state of being movably inserted. The coil spring 272 is, for example, a compression coil spring, and is held in a compressed state. Therefore, the coil spring 272 can bias the liquid piston 270, the piston guide 290, and the head 230 upward.

Furthermore, the liquid cylinder mechanism 222 includes the straight part 222*a* having a straight shape extending along the vertical direction, and a diameter-reduced part 222*b* connected below the straight part 222*a* and whose diameter is reduced downward. An inner circumference of a lower end part of the straight part 222*a* is provided with the spring bearing 274 that receives a lower end of the coil spring 272. In addition, a lower part of an inner circumferential surface of the diameter-reduced part 222*b* is provided with the valve seat 224 forming a pair with the valve body 278.

Furthermore, the diameter-reduced part 222*b* includes a cylindrical tube holding part 225 connected below the diameter-reduced part 222*b*. By an upper end part of a dip tube 228 being inserted to the tube holding part 225, the dip tube 228 is held by a lower end part of the cylinder 220. Thus, liquid in the container body 100 is sucked into the liquid pump chamber 280 via the dip tube 228.

In detail, when the head 230 is pushed down and the piston guide 290 moves down, friction between the piston guide 290 and an upper end part of the poppet 276 causes the poppet 276 to follow the piston guide 290, and the lower surface of the valve body 278 of the poppet 276 comes into liquid-tight contact with the valve seat 224 of the cylinder 220. At this time, the spring bearing 274 separates from the lower end of the coil spring 272 and moves down. After that, when, furthermore, the head 230, the piston guide 290, and the liquid piston 270 integrally move down after the lower surface of the valve body 278 comes into close contact with the valve seat 224, downward movement of the valve body 278 is regulated by the valve seat 224. Therefore, the piston guide 290 can move down relatively to the poppet 276 while frictionally sliding with respect to the upper end part of the poppet 276.

On the other hand, when the user's push-down operation on the head 230 is cancelled, and the liquid piston 270, the piston guide 290, and the head 230 integrally move up in accordance with biasing by the coil spring 272, first, the poppet 276 moves up to follow the piston guide 290 until the spring bearing 274 contacts the lower end of the coil spring 272. Thus, the valve body 278 and the valve seat 224 separate from each other. After that, the liquid piston 270, the piston guide 290, and the head 230 continue to move up integrally in accordance with biasing by the coil spring 272. At this time, since upward movement of the poppet 276 is regulated by the coil spring 272, the piston guide 290 moves up relatively to the poppet 276 while the upper end part of the poppet 276 frictionally slides with respect to the piston guide 290. As a result, the valve body 278 of the poppet 276 slightly moves up in a gap between the lower end of the coil spring 272 and the valve seat 224, so that the liquid suction valve at a lower end part of the liquid pump chamber 280 opens with the upward movement of the valve body 278, and liquid is sucked into the liquid pump chamber 280 via the liquid suction valve.

Note that a packing 190 is fitted onto the upper end part of the cylinder 220. In a state where the cap member 210 is attached to the container body 100 by screwing etc., an internal space of the container body 100 can be enclosed by the packing 190 being in airtight contact with an upper end of the neck 104.

<<Operation>>

Next, an operation of the gas cylinder mechanism 221 and the liquid cylinder mechanism 222 supplying gas and liquid to the foamer mechanism 300 in the embodiment of the present invention is described.

By the user performing push-down operation on the head 230, the liquid pump chamber 280 contracts. At this time, pressure is applied to liquid in the liquid pump chamber 280, so that the non-return valve constituted by the ball valve 180 and the valve seat 131 opens, and the liquid in the liquid pump chamber 280 is supplied to the foamer mechanism 300 via the non-return valve.

On the other hand, when the head 230 is subjected to push-down operation, the gas pump chamber 260 also contracts. At this time, pressure is applied to gas in the gas pump chamber 260, and the gas piston 250 slightly moves up with respect to the piston guide 290; thus, the gas exhaust valve constituted by the tubular part 251 and the valve-constituting groove 134 opens. As a result, the gas in the gas pump chamber 260 is sent upward via the gas exhaust valve and gas passages (not illustrated) provided between the tubular part 251 and the piston guide 290. Furthermore, a gas passage (not illustrated) constituted by a gap between the inner circumferential surface of the lower end part of the tubular part 234 and an outer circumferential surface of the piston guide 290 is provided above the tubular part 251 of the gas piston 250. The gas passage communicates with the gas passages provided between the tubular part 251 and the piston guide 290; hence, the gas in the gas pump chamber 260 is supplied to the foamer mechanism 300 via the gas exhaust valve, the gas passages provided between the tubular part 251 and the piston guide 290, and the gas passage provided between the inner circumferential surface of the lower end part of the tubular part 234 and the outer circumferential surface of the piston guide 290.

In more detail, first, in a normal state where the head 230 is not subjected to push-down operation, the head 230 is stopped at an upper limit position. In this state, the spring bearing 274 of the poppet 276 is in contact with the lower end of the coil spring 272, and the valve body 278 is slightly separated upward from the valve seat 224. Therefore, the liquid suction valve constituted by the valve body 278 and the valve seat 224 is in an open state. In addition, in this state, the ball valve 180 is in contact with the valve seat 131, and the non-return valve constituted by the ball valve 180 and the valve seat 131 is in a closed state.

Furthermore, in this state, the lower end part of the tubular part 251 of the gas piston 250 is engaged in the valve-constituting groove 134 on the upper surface of the flange 233 of the piston guide 290, and the gas exhaust valve constituted by the lower end of the tubular part 251 and the valve-constituting groove 134 is in a closed state. Furthermore, the valve body of the suction valve member 155 is in contact with the piston 252 of the gas piston 250, and the gas suction valve constituted by the valve body of the suction valve member 155 and the piston 252 is in a closed state. In addition, the through hole 229 of the gas cylinder mechanism 221 is blocked by the outer circumferential ring 253 of the gas piston 250.

Then, by the user pushing down the head 230, the piston guide 290 and the liquid piston 270 move down integrally with the head 230. With this downward movement, the coil spring 272 is compressed, and the volume of the liquid pump chamber 280 contracts. In an early stage of a process in which the piston guide 290 and the liquid piston 270 move down, the poppet 276 is caused to slightly move down to follow the piston guide 290 by friction with the piston guide 290. Thus, the valve body 278 comes into liquid-tight contact with the valve seat 224, and the liquid suction valve enters a closed state.

Furthermore, after the liquid suction valve enters a closed state, the liquid piston 270 further moves down, so that the volume of the liquid pump chamber 280 contracts, and pressure is applied to the liquid in the liquid pump chamber 280, and the liquid is sent upward. As a result, pressure of the sent liquid causes the ball valve 180 to float up from the valve seat 131, and the non-return valve enters an open state. Then, the liquid is supplied from the liquid pump chamber 280 to the foamer mechanism 300 via the non-return valve.

In addition, in the early stage of the process in which the liquid piston 270 and the piston guide 290 move down by the head 230 being pushed down, the gas piston 250 moves up relatively to the piston guide 290. Thus, the lower end part of the tubular part 251 of the gas piston 250 separates upward from the valve-constituting groove 134 of the flange 233, and the gas exhaust valve enters an open state.

After that, by the upper end part of the tubular part 251 coming into contact with the tubular part 234, relative upward movement of the gas piston 250 with respect to the head 230 and the piston guide 290 is regulated, and from then on, the gas piston 250 moves down integrally with the head 230 and the piston guide 290. As a result, the volume of the gas pump chamber 260 contracts, pressure is applied to the gas in the gas pump chamber 260, and the gas in the gas pump chamber 260 is supplied to the foamer mechanism 300 via the gas exhaust valve etc.

First Embodiment

Next, the foamer mechanism 300 according to a first embodiment of the present invention is described. The foamer mechanism 300 is a mechanism capable of mixing gas and liquid supplied from the gas cylinder mechanism 221 and the liquid cylinder mechanism 222 described above to foam the liquid. Details of the foamer mechanism 300 according to the present embodiment are described below.

<Configuration of Foamer Mechanism 300>

Figure 4:
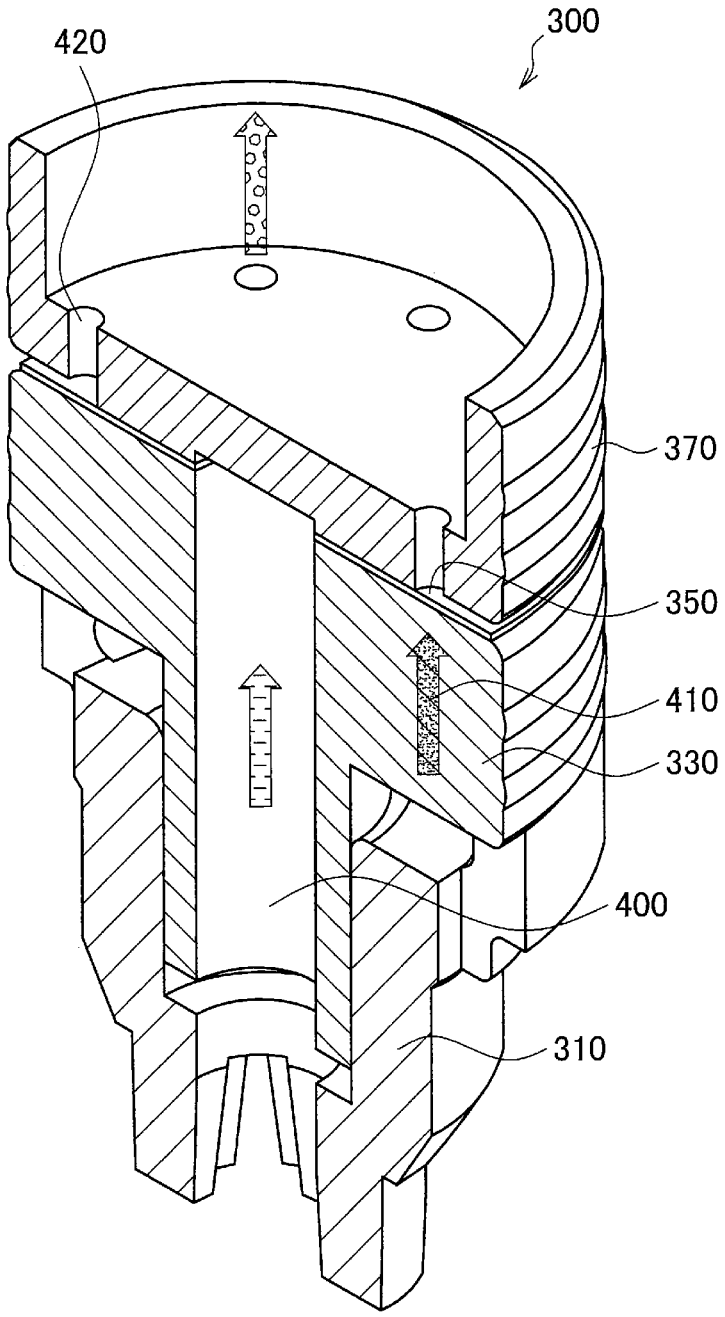
FIG. 4 is an explanatory diagram illustrating a perspective cross-section of a foamer mechanism 300 according to a first embodiment of the present invention.
Figure 5:
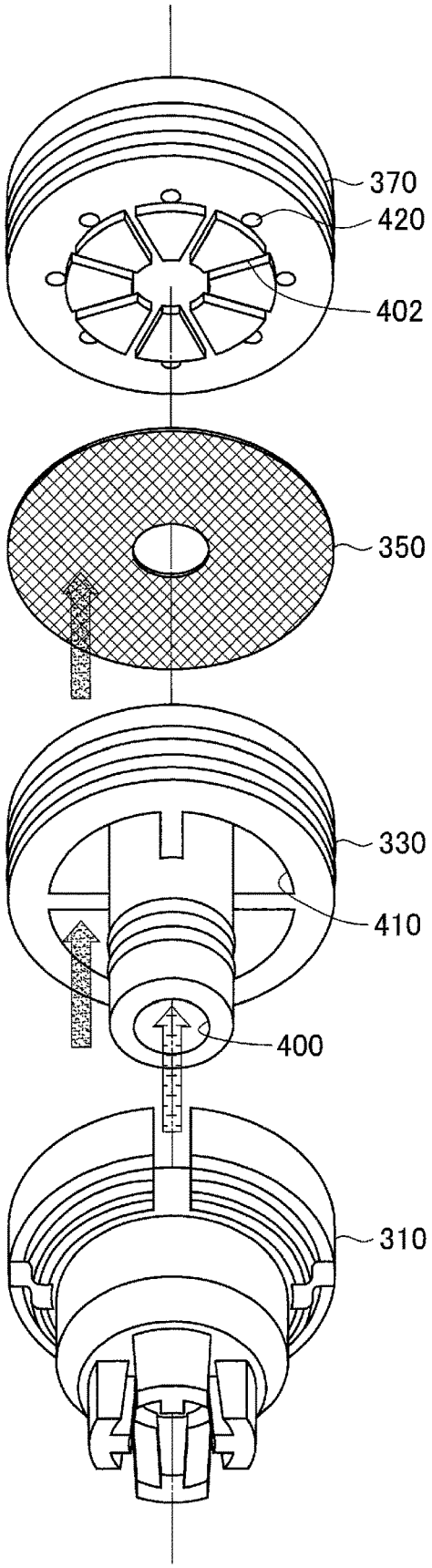
FIG. 5 is an exploded perspective view of the foamer mechanism 300 according to the embodiment.

First, a configuration of the foamer mechanism 300 according to the present embodiment is described with reference to FIGS. 4 and 5. FIG. 4 is an explanatory diagram illustrating a perspective cross-section of the foamer mechanism 300 according to the present embodiment, and in detail, illustrates a perspective view of a cross-section of the foamer mechanism 300 obtained by cutting the foamer mechanism 300 along the vertical direction so as to pass through a central axis of the foamer mechanism 300. FIG. 5 is an exploded perspective view of the foamer mechanism 300 according to the present embodiment, and shows a perspective view when components are viewed from below.

As illustrated in FIGS. 4 and 5, the foamer mechanism 300 according to the present embodiment includes a combination of four members of, from below, a first member 310, a second member 330, a third member 350, and a fourth member 370. In other words, the foamer mechanism 300 includes the first member 310, the second member 330, the third member 350, and the fourth member 370 stacked in this order.

In detail, in the foamer mechanism 300, part of the second member 330 is inserted into the first member 310, and the first member 310 and the second member 330 have center axes existing on the same axis, as illustrated in FIG. 4. Furthermore, a liquid passage (first liquid passage) 400 is provided to penetrate, along the vertical direction, central parts of the first member 310 and the second member 330 (respective central parts of the first member 310 and the second member 330 in planar view) aligned on the same axis. To the liquid passage 400, liquid supplied from the liquid cylinder mechanism 222 described above is supplied via the non-return valve constituted by the ball valve 180 and the valve seat 131. Furthermore, the liquid passage 400 supplies liquid to liquid passages (second liquid passages) 402 provided on the lower surface side of the fourth member 370 that mixes liquid and gas.

In addition, in the second member 330, a plurality of (e.g., four) gas passages 410 penetrating the second member 330 along the vertical direction are provided to surround the liquid passage 400 in the central part. Note that in the present embodiment, the number of the gas passages 410 is not particularly limited, but is preferably two or more, further preferably four or more. Furthermore, to the gas passages 410, gas supplied from the gas cylinder mechanism 221 is supplied via the gas exhaust valve constituted by the tubular part 251 and the valve-constituting groove 134, the gas passages (not illustrated) provided between the tubular part 251 and the piston guide 290, and the gas passage (not illustrated) constituted by the gap between the inner circumferential surface of the lower end part of the tubular part 234 and the outer circumferential surface of the piston guide 290.

Furthermore, the gas passages 410 supply gas to the liquid passages 402 provided on the lower surface side of the fourth member 370 via the third member 350 including a porous member and provided to be sandwiched between the second member 330 and the fourth member 370. Note that in FIG. 4, the liquid passage 400 and the gas passages 410 described above extend along the vertical direction, that is, extend to be parallel to each other.

Furthermore, the fourth member 370 provided to be in contact with the second member 330 via the third member 350 is provided with a plurality of (e.g., eight) axial through holes (holes) 420 penetrating the fourth member 370 along the vertical direction. Liquid and gas supplied to the liquid passages 402 provided on the lower surface side of the fourth member 370 mix with each other into foamy liquid. Then, the foamy liquid is pushed out by liquid and gas newly supplied to the liquid passages 402, thus being exhausted to the upper surface side of the fourth member 370 via the axial through holes 420. Furthermore, as described above, the exhausted foamy liquid is discharged to the outside of the foaming dispenser container 10 from the discharge opening 242 of the nozzle 240 of the cap member 210. That is, it can be said that the axial through holes 420 are provided on the downstream side of the gas passages 410, and communicate with the discharge opening 242. Note that in the present embodiment, the number of the axial through holes 420 is not particularly limited, but is preferably two or more, further preferably four or more, still further preferably eight or more.

Furthermore, details of each of the four members, the first member 310, the second member 330, the third member 350, and the fourth member 370, constituting the foamer mechanism 300 according to the present embodiment will be described.

(First Member 310)

Figure 6:
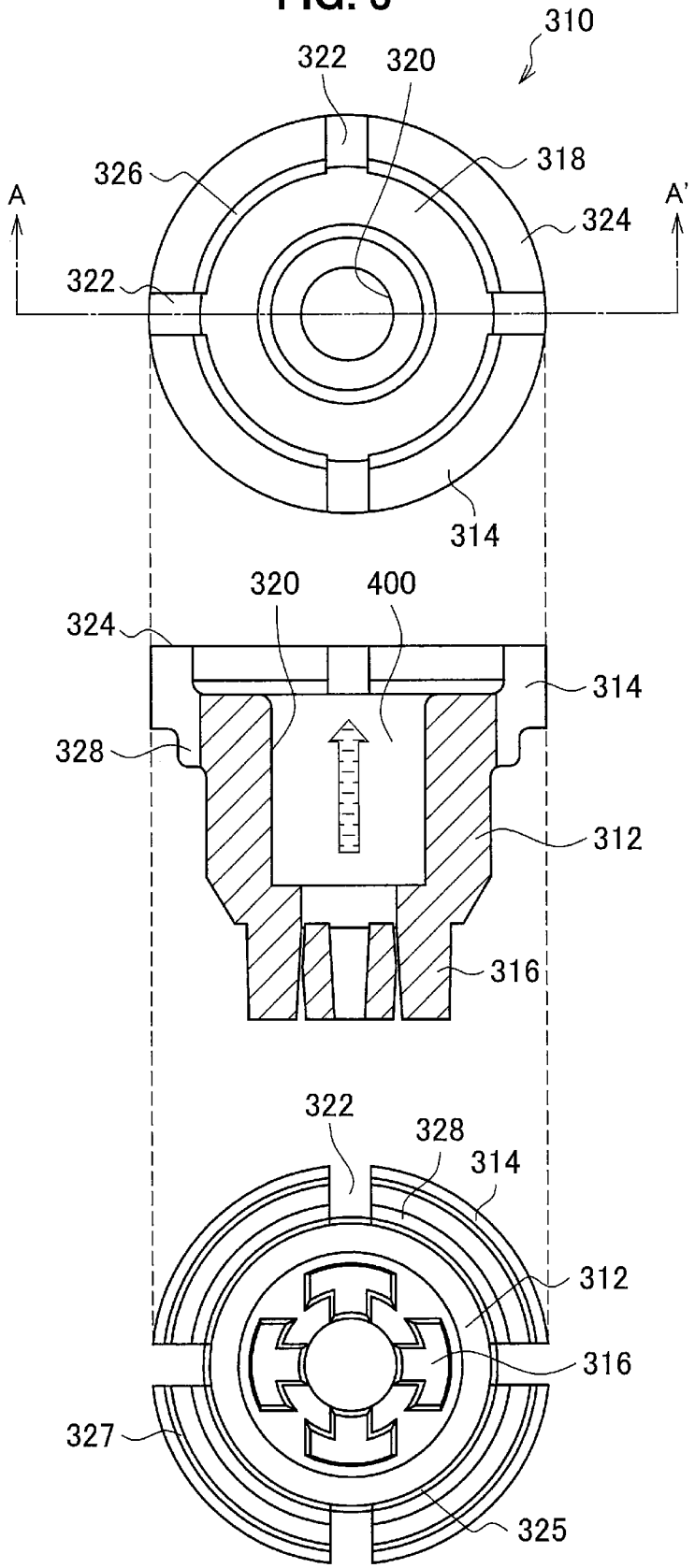
FIG. 6 is an explanatory diagram of a first member 310 according to the embodiment.

First, details of the first member 310 are described with reference to FIG. 6. FIG. 6 is an explanatory diagram of the first member 310 according to the present embodiment, and in detail, includes, from above, a top view of the first member 310, a cross-sectional view of the first member 310 obtained by cutting the first member 310 along the vertical direction, and a bottom view of the first member 310. In more detail, the cross-sectional view corresponds to a cross-section of the first member 310 obtained by cutting the first member 310 along line A-A' in the top view.

As illustrated in FIG. 6, the first member 310 mainly includes a combination of two tubular members and a plurality of vane-shaped members. In detail, the first member 310 mainly includes a tubular small diameter part 312, a tubular large diameter part 314 located above the small diameter part 312 and having a larger diameter than the small diameter part 312, and a plurality of (e.g., four) vane-shaped projections 316 projecting downward from a lower end of the small diameter part 312.

In more detail, as illustrated in the top view of the first member 310, the large diameter part 314 includes a bottom plate 318 provided horizontally inside its central part, an axial through hole 320 provided in a central part of the bottom plate 318, and an outer circumferential wall 324 provided to surround an outer circumference of the bottom plate 318. In detail, the axial through hole 320 penetrates the central part of the bottom plate 318 along the vertical direction. In addition, an outer circumferential surface of the outer circumferential wall 324 is provided with a plurality of (e.g., four) axial grooves 322 extending along the vertical direction. These axial grooves 322 are provided on the outer circumferential surface at equiangular intervals along a circumferential direction. Furthermore, in the case where the large diameter part 314 is viewed from above, a groove 326 is provided between the bottom plate 318 and the outer circumferential wall 324.

In addition, as illustrated in the cross-sectional view and the bottom view of the first member 310, on the outer circumferential surface of the outer circumferential wall 324 of the large diameter part 314, an outer circumferential wall 328 having a smaller diameter than the outer circumferential wall 324 is provided below a lower end of the outer circumferential wall 324 to surround an outer circumferential surface of the small diameter part 312.

In addition, in the case where the first member 310 is viewed from below, a groove 327 is provided between the outer circumferential wall 324 and the outer circumferential wall 328. Furthermore, a groove 325 is provided between the outer circumferential wall 328 and the small diameter part 312. These axial grooves 322 and grooves 325, 326, and 327 can function as gas passages for communicating with the gas passages 410 of the second member 330 and sending gas.

In addition, the axial through hole 320 communicates with the tubular small diameter part 312, and part of the second member 330 described later is engaged in a space formed by their communication. By such engagement, the first member 310 and the second member 330 are fixed to each other. Furthermore, a size of an inner diameter of the small diameter part 312 is substantially the same as an inner diameter of the axial through hole 320, but is smaller than the inner diameter of the axial through hole 320 at the lower end of the small diameter part 312.

Furthermore, the plurality of vane-shaped projections 316 are disposed at equiangular intervals along the circumferential direction of the lower end of the small diameter part 312. Lower ends of vanes of the projections 316 face the ball valve 180 described above. Therefore, in the case where the ball valve 180 moves upward, the ball valve 180 comes into contact with lower ends of the projections 316; hence, the lower ends of the projections 316 can regulate the upward movement of the ball valve 180. Note that in the present embodiment, the number of the projections 316 is not particularly limited, but is preferably three or more, further preferably four or more.

(Second Member 330)

Figure 7:
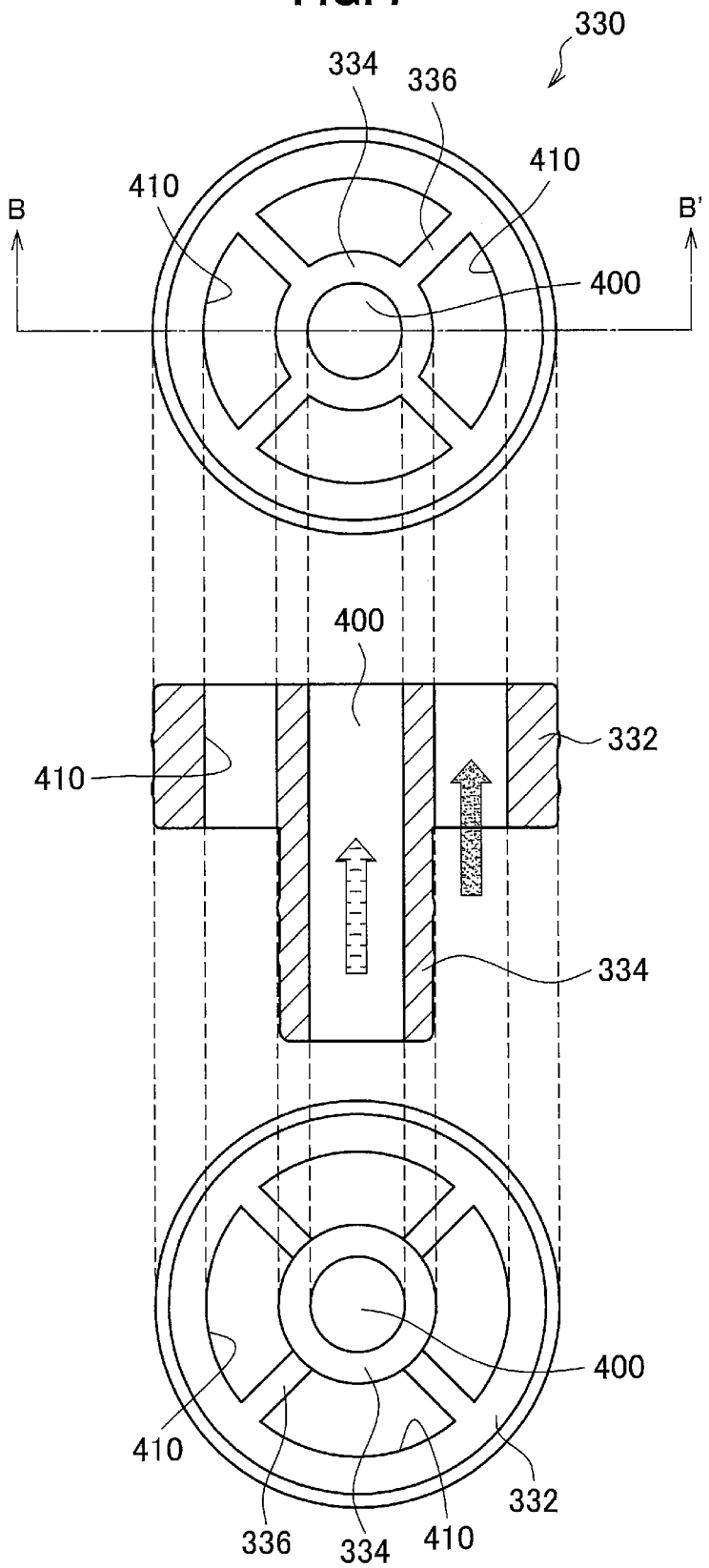
FIG. 7 is an explanatory diagram of a second member 330 according to the embodiment.

Next, details of the second member 330 are described with reference to FIG. 7. FIG. 7 is an explanatory diagram of the second member 330 according to the present embodiment, and in detail, includes, from above, a top view of the second member 330, a cross-sectional view of the second member 330 obtained by cutting the second member 330 along the vertical direction, and a bottom view of the second member 330. In more detail, the cross-sectional view corresponds to a cross-section of the second member 330 obtained by cutting the second member 330 along line B-B' in the top view.

As illustrated in the top view and the cross-sectional view of the second member 330, the second member 330 includes a combination of two tubular members. In detail, the second member 330 includes a tubular large diameter part 332 provided on the upper side of the second member 330, and a tubular small diameter part 334 inserted into a central part of the large diameter part 332 (a central part in planar view of the large diameter part 332) and drooping downward from the central part. The small diameter part 334 has a smaller diameter than the large diameter part 332, but has a longer long axis than the large diameter part 332. Furthermore, as illustrated in the top view and the bottom view of the second member 330, the second member 330 includes a plurality of (e.g., four) rectangular coupling parts 336 that couple the large diameter part 332 and the small diameter part 334.

In more detail, the small diameter part 334 is inserted into the axial through hole 320 of the first member 310 described above, and the inside of the small diameter part 334 communicates with the inside of the small diameter part 312 of the first member 310 to function as the liquid passage (first liquid passage) 400 described above. That is, the liquid passage 400 penetrates the central part of the second member 330 (the central part in planar view of the second member 330) along the vertical direction, and can send liquid from the upstream side (below) to the downstream side (above) along the vertical direction.

In addition, as illustrated in the top view and the bottom view of the second member 330, a space between the small diameter part 334 and the large diameter part 332 is partitioned by the plurality of rectangular coupling parts 336 to constitute the plurality of (e.g., four) gas passages 410. In other words, the plurality of gas passages 410 are provided to surround the liquid passage 400 penetrating the central part of the second member 330 (the central part in planar view of the second member 330). The gas passages 410 are provided to penetrate the large diameter part 332 of the second member 330 along the vertical direction, and can send gas from the upstream side (below) to the downstream side (above) along the vertical direction. Furthermore, the gas passage 410 has a substantially fan-shaped opening as illustrated in the top view and the bottom view of the second member 330, but in the present embodiment, is not particularly limited as long as the plurality of gas passages 410 have substantially the same shape. For example, the shape of the opening of the gas passage 410 may be a rectangle, a circle, an ellipse, or the like. In addition, in the present embodiment, the number of the gas passages 410 is not particularly limited, but is preferably two or more, further preferably four or more.

(Third Member 350)

The third member 350 is a porous member sandwiched between the second member 330 and the fourth member 370 as illustrated in FIG. 5. The third member 350 can be a circular annular (doughnut-shaped) disk, for example, and its inner diameter is substantially the same as the inner diameter of the small diameter part 312 of the second member 330, and the third member 350 and the second member 330 are disposed in a manner that their central axes exist on the same axis. That is, liquid sent by the liquid passage 400 of the second member 330 passes through a central part (hollow part) of the circular annular disk; hence, the liquid is supplied to the liquid passages 402 provided on a lower surface of the fourth member 370 without passing through the porous member of the third member 350. Thus, since the liquid does not pass through the porous member of the third member 350, even in the case where the liquid includes particles etc., the particles etc. do not cause clogging of the porous member.

On the other hand, gas sent by the gas passages 410 of the second member 330 comes into contact with the liquid flowing through the liquid passages 402 provided on the lower surface of the fourth member 370, via the porous member of the third member 350, because end faces of the gas passages 410 are in contact with a lower surface (upstream side) of the third member 350. In detail, the gas sent by the gas passages 410 comes into contact with the liquid flowing through the liquid passages 402, via the porous member of the third member 350, at least near the axial through holes 420 (see FIG. 8) of the fourth member 370, to mix with the liquid.

Note that the lower surface of the third member 350 is in close contact with an upper surface of the second member 330, in detail, in close contact with upper surfaces of the large diameter part 332, the small diameter part 334, and the coupling parts 336 of the second member 330. Furthermore, an upper surface of the third member 350 is in close contact with the lower surface of the fourth member 370, in detail, in close contact with lower surfaces of liquid passage walls 376 of the fourth member 370.

In the present embodiment, the third member 350 may be fixed to the large diameter part 332 of the second member 330 by fusion or adhesion, or fixed between the second member 330 and the fourth member 370 in a detachable state. In addition, the shape of the third member 350 is not limited to a circular annular (doughnut-shaped) disk as illustrated in FIG. 5 and may be a cylinder having thickness along the vertical direction, and is not particularly limited.

For example, the porous member may be mesh, gauze, a foam, sponge, or a combination of two or more selected from these. In detail, a size of aperture of the porous member is preferably 20 μm or more, further preferably 40 μm or more, and preferably 350 μm or less, further preferably 300 μm or less. The aperture means lengthwise and breadthwise lengths of a rectangular opening in the case where the porous member includes mesh with rectangular openings, and means a diameter of a circle in the case where the porous member has circular openings. More specifically, for example, as the porous member, commercially available mesh sheets of mesh sizes #50 to #550 can be used, and preferably, commercially available mesh sheets of mesh sizes #85 to #350 can be used. As the mesh sheet, for example, #61, #508, #85, and #305 can be used.

(Fourth Member 370)

Figure 8:
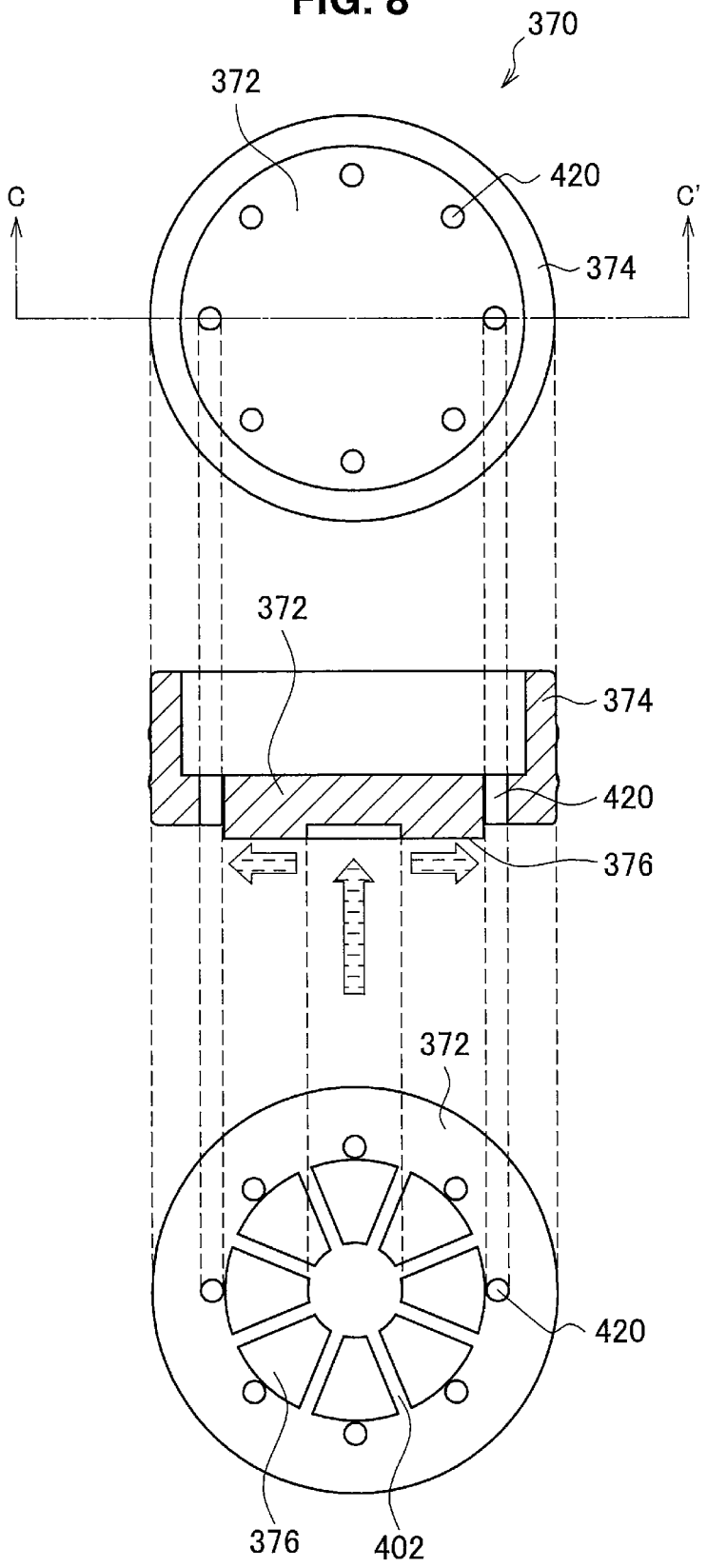
FIG. 8 is an explanatory diagram of a fourth member 370 according to the embodiment.
Figure 9:
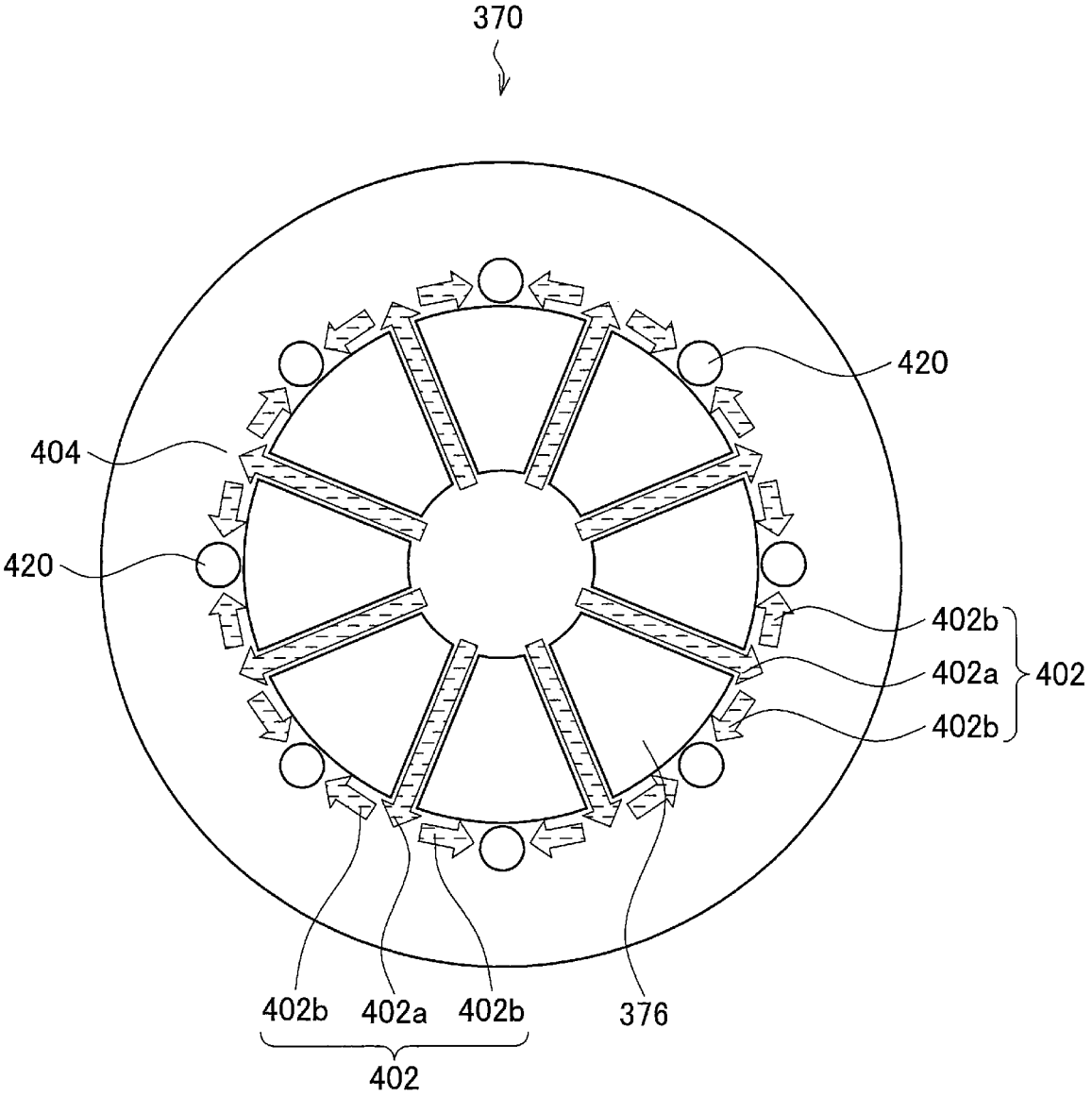
FIG. 9 is an explanatory diagram for describing liquid passages 402 provided on the fourth member 370 according to the embodiment.

Next, details of the fourth member 370 are described with reference to FIGS. 8 and 9. FIG. 8 is an explanatory diagram of the fourth member 370 according to the present embodiment, and in detail, includes, from above, a top view of the fourth member 370, a cross-sectional view of the fourth member 370 obtained by cutting the fourth member 370 along the vertical direction, and a bottom view of the fourth member 370. In more detail, the cross-sectional view corresponds to a cross-section of the fourth member 370 obtained by cutting the fourth member 370 along line C-C' in the top view. In addition, FIG. 9 is an explanatory diagram for describing the liquid passages 402 provided on the lower surface of the fourth member 370 according to the present embodiment, and in detail, is a bottom view of the fourth member 370.

As illustrated in FIG. 8, the fourth member 370 is a disk-shaped (circular-plate-shaped, dish-shaped) member. The fourth member 370 is disposed in a manner that its central axis exists on the same axis as the central axis of the second member 330, and a lower surface of the disk-shaped member of the fourth member 370 is in close contact with the second member 330 via the third member 350 described above. In detail, as illustrated in the top view of the fourth member 370, the fourth member 370 includes a bottom plate 372 provided horizontally inside its central part, and an outer circumferential wall 374 provided to surround an outer circumference of the bottom plate 372 and extending upward from an upper surface of the bottom plate 372. A portion projecting from a lower surface of the bottom plate 372 is in airtight contact with the second member 330 via the third member 350 (details are described later). Furthermore, the plurality of (e.g., eight) circular axial through holes 420 penetrating the bottom plate 372 in the vertical direction are provided near the outer circumference of the bottom plate 372. The plurality of axial through holes 420 are provided at equiangular intervals along the circumferential direction of the outer circumference of the bottom plate 372. As described above, liquid that has been mixed with gas in the liquid passages 402 on the lower surface of the fourth member 370 to be foamed passes through the axial through holes 420 to be exhausted onto the upper surface of the bottom plate 372 surrounded by the outer circumferential wall 374, in other words, to the upper surface side of the fourth member 370. Note that in the present embodiment, the shape of the axial through hole 420 is not limited to a circular shape as illustrated in FIG. 8, and may be an ellipse, a rectangle, or the like, for example.

Furthermore, as illustrated in the bottom view of the fourth member 370, the lower surface of the bottom plate 372 is provided with the liquid passages 402. In detail, a central part of the lower surface of the bottom plate 372 faces the liquid passage 400 of the second member 330; therefore, the liquid sent by the liquid passage 400 hits the central part to flow along an in-plane direction (e.g., a horizontal direction) of the lower surface of the bottom plate 372. That is, the lower surface of the fourth member 370, in other words, the lower surface of the bottom plate 372, can change a direction in which liquid flows from the vertical direction to the in-plane direction of the lower surface.

In more detail, the lower surface of the bottom plate 372 is provided with a plurality of (e.g., eight) liquid passages 402 branching and extending radially from the central part where the liquid passage 400 meets. In other words, the liquid passages 402 extend along the in-plane direction of the lower surface of the bottom plate 372. Furthermore, the liquid passages 402 extending radially are provided at equiangular intervals along the circumferential direction of the outer circumference of the bottom plate 372.

As illustrated in the bottom view of the fourth member 370, the plurality of liquid passages 402 have their outlines defined by a plurality of (e.g., eight) substantially fan-shaped (or having a shape of an isosceles triangle lacking the top) liquid passage walls 376 provided to surround the central part of the lower surface of the bottom plate 372 and projecting downward from the lower surface of the bottom plate 372. Lower ends of the liquid passage walls 376 are in airtight contact with a surface of the third member 350 on the downstream side of the gas passages 410. Therefore, the liquid passage walls 376 can define a flow direction of liquid by being in contact with the third member 350, and in addition, indirectly regulate upward movement of the third member 350 and the second member 330 located below the third member 350 due to gas supplied from the gas passages 410.

In detail, as illustrated in FIG. 9, one liquid passage 402 includes a first portion 402*a* extending radially from the central part of the lower surface of the bottom plate 372, and two second portions 402*b* branching, bending, and extending from the first portion 402*a*. The second portion 402*b* may bend from the first portion 402*a* to draw an arc, or may bend from the first portion 402*a* to form a right angle, and is not particularly limited. Furthermore, second portions 402*b* of different plurality of liquid passages 402 communicate with each other to constitute an annular liquid passage 404 extending along the outer circumference of the bottom plate 372. In addition, the axial through hole 420 described above is provided at a position facing the annular liquid passage 404, that is, the axial through hole 420 is open to the annular liquid passage 404. In more detail, the axial through hole 420 is preferably provided to be open to a region where second portions 402*b* of different liquid passages 402 meet each other. In this specification, a region where second portions 402*b* of different liquid passages 402 meet each other is referred to as a liquid passage meeting. That is, it can be said that the liquid passage meeting is a region where the second portion 402*b* of one liquid passage 402 meets the second portion 402*b* of another liquid passage 402. By being guided to such a liquid passage 402, the liquid supplied to the central part of the lower surface of the bottom plate 372 by the liquid passage 400 branches into the first portion 402*a*, further passes through the second portion 402*b*, and flows to the liquid passage meeting to flow toward the axial through hole 420.

More specifically, in one liquid passage 402, the two second portions 402*b* preferably have substantially the same length. Furthermore, in the plurality of liquid passages 402, it is preferable that the first portions 402*a* have substantially the same length and the second portions 402*b* have substantially the same length. Furthermore, in the plurality of liquid passages 402, it is preferable that the first portions 402*a* have substantially the same width and the second portions 402*b* have substantially the same width. At the liquid passage meeting, liquids that flow in from two second portions 402*b* flow in directions opposite to each other, and it can be said that the liquids that flow in from the two second portions 402*b* hit each other. However, in the case where the central part of the lower surface of the bottom plate 372 where a flow direction has changed is regarded as a starting point, liquids that flow into the liquid passage meeting from two second portions 402*b* have flowed through substantially the same path length, if the first portions 402*a* have substantially the same length and width and the second portions 402*b* have substantially the same length and width, though the paths to the liquid passage meeting are different. Therefore, at the liquid passage meeting, liquids that flow in from two second portions 402*b* have substantially equal flow intensity (flow velocity, pressure), and the liquids from the two second portions 402*b* can flow in toward the liquid passage meeting in good balance.

In addition, the liquid passages 402 are entirely open on the lower side, that is, the gas passage 410 side of the second member 330. That is, the liquid passages 402 entirely communicate with the gas passages 410 via the third member 350. Therefore, the gas passages 410 can supply gas to the liquid flowing through the liquid passages 402. Note that in the present embodiment, the liquid passages 402 are not limited to entirely communicating with the gas passages 410, and for example, the liquid passages 402 and the gas passages 410 may communicate only at the liquid passage meetings or near the liquid passage meetings.

Furthermore, as described above, the liquid passages 402 extend along the in-plane direction of the lower surface of the bottom plate 372. On the other hand, the gas passages 410 extend along a direction perpendicular to the lower surface, that is, the vertical direction. In other words, in places where the liquid passages 402 and the gas passages 410 meet each other, the liquid passages 402 and the gas passages 410 meet perpendicularly to each other. Furthermore, at the liquid passage meeting, the gas passage 410 can supply gas evenly to both of liquids flowing in from two directions in the lower surface of the bottom plate 372 toward the axial through hole 420 in good balance. As a result, in the present embodiment, liquid and gas can sufficiently mix, so that suitable foamy liquid can presumably be obtained. Note that in the present embodiment, the liquid passages 402 and the gas passages 410 are not limited to meeting perpendicularly, as long as the gas passages 410 extend in a direction different from the in-plane direction of the lower surface in which the liquid passages 402 extend, in places where the liquid passages 402 and the gas passages 410 meet each other.

Note that in the present embodiment, the number of the liquid passages 402 is not particularly limited, but is preferably two or more, further preferably four or more, still further preferably eight or more.

As described above, in the present embodiment, the gas passages 410 and the liquid passages 402 have the modes described above; thus, liquid can flow into the axial through hole 420 in good balance from second portions 402*b* of two liquid passages 402 extending in the in-plane direction of the lower surface of the fourth member 370. Furthermore, from the gas passage 410 extending in a direction different from the in-plane direction, gas can be supplied evenly to both of liquids flowing in from the two second portions 402*b* in good balance. As a result, according to the present embodiment, liquid and gas can sufficiently mix, so that suitable foamy liquid can presumably be obtained.

Furthermore, in the present embodiment, gas sent by the gas passages 410 can be supplied to liquid flowing through the liquid passages 402 via the third member 350, which is a porous member. Thus, in the present embodiment, since the liquid does not pass through the porous member of the third member 350, even in the case where the liquid includes particles etc., the particles etc. do not cause clogging of the porous member. As a result, even liquid that contains particles etc. and thus has been unable to be foamed can be foamed by the foamer mechanism 300 according to the present embodiment.

Second Embodiment

Furthermore, a foamer mechanism according to an embodiment of the present invention may have a mode different from the first embodiment. Hence, details of a foamer mechanism 300*a* having another different mode are described below as a second embodiment of the present invention.

<Configuration of Foamer Mechanism 300*a*>

Figure 10:
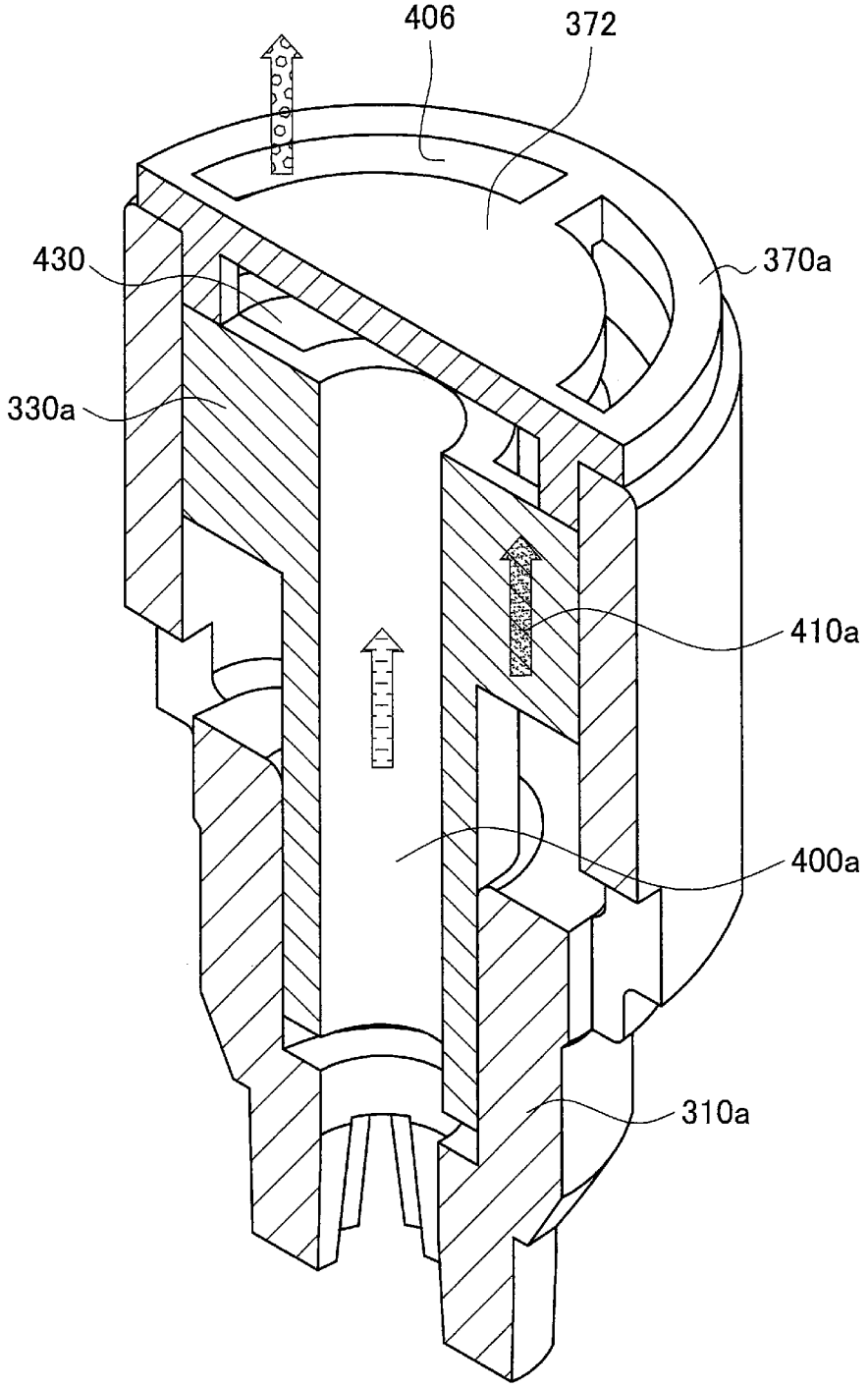
FIG. 10 is an explanatory diagram illustrating a perspective cross-section of a foamer mechanism 300*a* according to a second embodiment of the present invention.

A configuration of the foamer mechanism 300*a* according to the present embodiment is described with reference to FIGS. 10 and 11. FIG. 10 is an explanatory diagram illustrating a perspective cross-section of the foamer mechanism 300*a* according to the present embodiment, and in detail, illustrates a perspective view of a cross-section of the foamer mechanism 300*a* obtained by cutting the foamer mechanism 300*a* along the vertical direction so as to pass through a central axis of the foamer mechanism 300*a*. Note that in FIG. 10, for easy understanding, illustration of the third member 350 is omitted. In addition, FIG. 11 is an exploded perspective view of the foamer mechanism 300*a* according to the present embodiment, and shows a perspective view when components are viewed from below.

Figure 11:
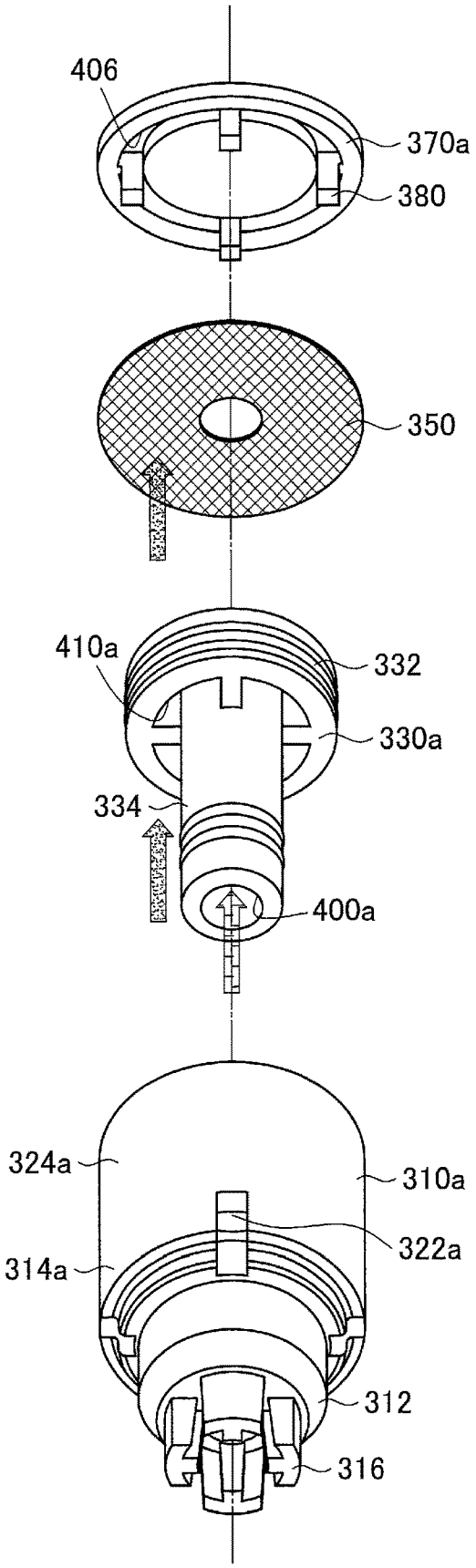
FIG. 11 is an exploded perspective view of the foamer mechanism 300*a* according to the embodiment.

As illustrated in FIGS. 10 and 11, the foamer mechanism 300*a* according to the present embodiment includes a combination of four members of, from below, a first member 310*a*, a second member 330*a*, the third member 350, and a fourth member (contact member) 370*a*. In other words, the foamer mechanism 300*a* includes the first member 310*a*, the second member 330*a*, the third member 350, and the fourth member 370*a* stacked in this order.

In detail, in the foamer mechanism 300*a*, part of the second member 330*a* is inserted into the first member 310*a*, and the first member 310*a* and the second member 330*a* have center axes existing on the same axis, as illustrated in FIG. 10. Furthermore, a liquid passage (first liquid passage) 400*a* is provided to penetrate, along the vertical direction, central parts of the first member 310*a* and the second member 330*a* (respective central parts of the first member 310*a* and the second member 330*a* in planar view) aligned on the same axis. To the liquid passage 400*a*, liquid supplied from the liquid cylinder mechanism 222 is supplied via the non-return valve. Furthermore, the liquid passage 400*a* communicates with a central part (central region) of a mixing chamber 430 (a central part in planar view of the mixing chamber 430) provided between the second member 330*a* and the fourth member 370*a*, thereby supplying liquid to the central part.

In addition, in the second member 330*a*, a plurality of (e.g., four) gas passages 410*a* penetrating the second member 330*a* along the vertical direction are provided to surround the liquid passage 400*a* located in the central part. Therefore, it can be said that the gas passages 410*a* communicate with a region surrounding the central part of the mixing chamber 430. Note that in the present embodiment, the number of the gas passages 410*a* is not particularly limited, but is preferably two or more, further preferably four or more. Furthermore, to the gas passages 410*a*, gas supplied from the gas cylinder mechanism 221 is supplied. Then, the gas passages 410*a* can supply the gas to the region surrounding the central part of the mixing chamber 430 via the third member 350 including a porous member. Note that in the mixing chamber 430, liquid and gas mix with each other, so that the liquid can be foamed. In addition, in FIG. 10, the liquid passage 400*a* and the gas passages 410*a* described above extend along the vertical direction, that is, extend to be parallel to each other.

Furthermore, the fourth member 370*a* provided to be in contact with the second member 330*a* via the third member 350 is provided with a plurality of (e.g., four) foamy liquid passages 406 penetrating the fourth member 370*a* along the vertical direction. That is, it can be said that the foamy liquid passages 406 are provided on the downstream side of the gas passages 410*a*. The liquid foamed in the mixing chamber 430 is exhausted to the upper surface side of the fourth member 370*a* via the foamy liquid passages 406. Furthermore, the exhausted foamy liquid is temporarily reserved in a space on the upper surface of the fourth member 370*a*, and then discharged to the outside of the foaming dispenser container 10 from the discharge opening 242 of the nozzle 240 of the head 230. In the following description, the space on the upper surface of the fourth member 370*a* is called a reserving chamber 440, and more suitable foamy liquid can presumably be obtained by temporarily reserving the foamed liquid in the reserving chamber 440. Therefore, it can also be said that the fourth member 370*a* is a member for partitioning the mixing chamber 430 and the reserving chamber 440. In other words, the reserving chamber 440 is partitioned by the fourth member 370*a* to be formed on the downstream side of the mixing chamber 430. Note that in the present embodiment, the number of the foamy liquid passages 406 is not particularly limited, but is preferably two or more, further preferably four or more.

Details of the four members, the first member 310*a*, the second member 330*a*, the third member 350, and the fourth member 370*a*, constituting the foamer mechanism 300*a* according to the present embodiment are described below. Note that the four members constituting the foamer mechanism 300*a* according to the present embodiment have points in common with the four members constituting the foamer mechanism 300 according to the first embodiment; hence, description about the common points is omitted here, and only differences are described.

(First Member 310*a*)

As illustrated in FIG. 11, the first member 310*a* mainly includes a combination of two tubular members and a plurality of vane-shaped members, as in the first embodiment. In detail, the first member 310*a* mainly includes the tubular small diameter part 312, a tubular large diameter part 314*a* located above the small diameter part 312 and having a larger diameter than the small diameter part 312, and the plurality of (e.g., four) vane-shaped projections 316 projecting downward from a lower end of the small diameter part 312. Note that in the present embodiment, the small diameter part 312 and the projections 316 are substantially similar to the small diameter part 312 and the projections 316 of the first member 310 in the first embodiment, and the large diameter part 314*a* is partly different from the large diameter part 314 of the first member 310 in the first embodiment.

In detail, the large diameter part 314*a* according to the present embodiment includes an outer circumferential wall 324*a* provided to surround the outer circumference of the bottom plate 318; the height of the wall extending upward from an upper surface of the bottom plate 318 is higher, as compared with the outer circumferential wall 324 of the first embodiment. Furthermore, an outer circumferential surface of the outer circumferential wall 324*a* is provided with a plurality of (e.g., four) openings 322*a*, instead of the axial grooves 322 according to the first embodiment. Like the axial grooves 322 according to the first embodiment, the openings 322*a* can function as gas passages that communicate with the gas passages 410 of the second member 330 to send gas.

(Second Member 330*a*)

As illustrated in FIG. 11, the second member 330*a* according to the present embodiment includes a combination of two tubular members, like the second member 330 according to the first embodiment. In detail, the second member 330*a* includes the tubular large diameter part 332 provided on the upper side of the second member 330*a*, and the tubular small diameter part 334 inserted into a central part of the large diameter part 332 (a central part in planar view of the large diameter part 332) and drooping downward from the central part. Note that in the present embodiment, a length of a long axis of the small diameter part 334 in the vertical direction may be longer than that of the small diameter part 334 according to the first embodiment, and the length can be changed as appropriate.

(Third Member 350)

As illustrated in FIG. 11, the third member 350 according to the present embodiment includes a porous member that is, for example, a doughnut-shaped (annular, loop-shaped, ring-shaped) disk, like the third member 350 according to the first embodiment. Note that the third member 350 according to the present embodiment is similar to the third member 350 according to the first embodiment; hence, detailed description of the third member 350 is omitted here.

(Fourth Member 370*a*)

As illustrated in FIG. 11, the fourth member 370*a* according to the present embodiment is a disk-shaped member having a mode different from the first embodiment. In detail, the fourth member 370*a* includes the bottom plate 372 that is disk-shaped and provided horizontally inside its central part (a central part in planar view of the fourth member 370*a*), and the plurality of (e.g., four) foamy liquid passages 406 provided at equiangular intervals along the circumferential direction along the outer circumference of the bottom plate 372 to surround a central part of the bottom plate 372 (a central part in planar view of the bottom plate 372). The foamy liquid passages 406 penetrate the bottom plate 372 along the vertical direction, and causes the mixing chamber 430 located below the fourth member 370*a* and the reserving chamber 440 located above the fourth member 370*a* to communicate with each other. Therefore, the foamy liquid passages 406 can send liquid foamed in the mixing chamber 430 located between the fourth member 370*a* and the second member 330*a* to the reserving chamber 440 located above the fourth member 370*a*. In other words, it can also be said that the fourth member 370*a* is a member that partitions the mixing chamber 430 and the reserving chamber 440. Furthermore, in the case where the fourth member 370*a* is viewed from above, the foamy liquid passages 406 are illustrated as substantially fan-shaped (or having a shape of an isosceles triangle lacking the top) openings provided to surround the central part of the bottom plate 372. Note that the opening of the foamy liquid passage 406 is not limited to being substantially fan-shaped as illustrated in FIG. 10, and the shape may be a circle, an ellipse, a rectangle, or the like, for example.

Furthermore, the fourth member 370*a* has a plurality of (e.g., four) legs 380 extending downward from the lower surface of the bottom plate 372, and lower ends of the legs 380 are in close contact with the second member 330*a* via the third member 350 described above. Therefore, the lower ends of the legs 380 are in contact with a surface of the third member 350 on the downstream side of the gas passages 410*a*, and thus can indirectly regulate upward movement of the third member 350 and the second member 330*a* located below the third member 350 due to gas supplied from the gas passages 410*a*.

As described above, in the present embodiment, gas sent by the gas passages 410*a* can pass through the third member 350, which is a porous member, to become fine bubbles and be supplied to the mixing chamber 430. Thus, in the present embodiment, since the liquid does not pass through the porous member of the third member 350, even in the case where the liquid includes particles etc., the particles etc. do not cause clogging of the porous member. As a result, even liquid that contains particles etc. and thus has been unable to be foamed can be foamed by the foamer mechanism 300*a* according to the present embodiment.

<Modification>

Figure 12:
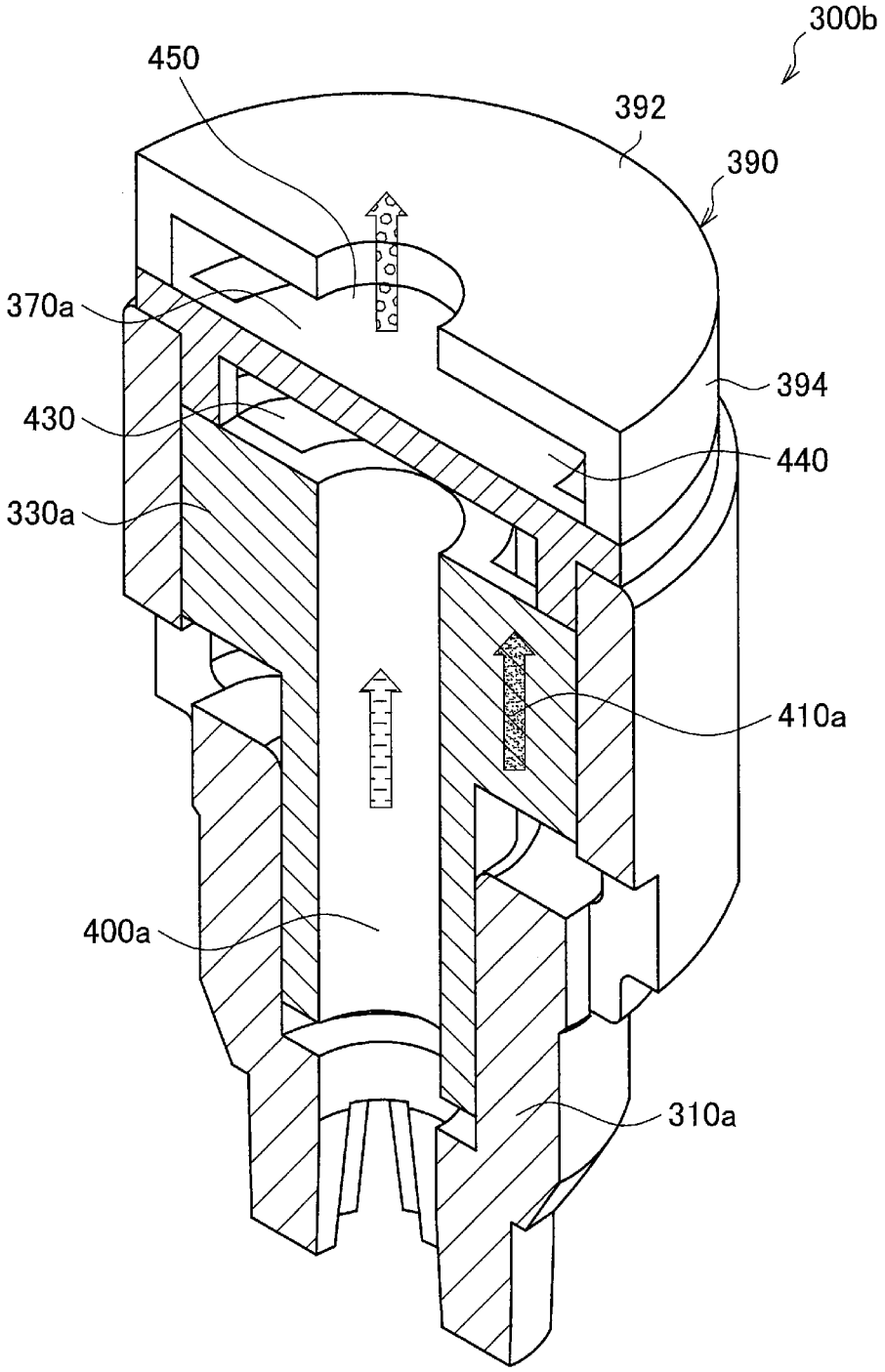
FIG. 12 is an explanatory diagram illustrating a perspective cross-section of a foamer mechanism 300*b* according to a modification of the second embodiment of the present invention.

The foamer mechanism 300*a* according to the second embodiment described above can be further modified. A foamer mechanism 300*b* according to a modification of the present embodiment is described below with reference to FIGS. 12 and 13. FIG. 12 is an explanatory diagram illustrating a perspective cross-section of the foamer mechanism 300*b* according to the present embodiment, and in detail, illustrates a perspective view of a cross-section of the foamer mechanism 300*b* obtained by cutting the foamer mechanism 300*b* along the vertical direction so as to pass through a central axis of the foamer mechanism 300*b*. Note that in FIG. 12, for easy understanding, illustration of the third member 350 is omitted. In addition, FIG. 13 is an exploded perspective view of the foamer mechanism 300*b* according to the present embodiment, and shows a perspective view when components are viewed from below.

Figure 13:
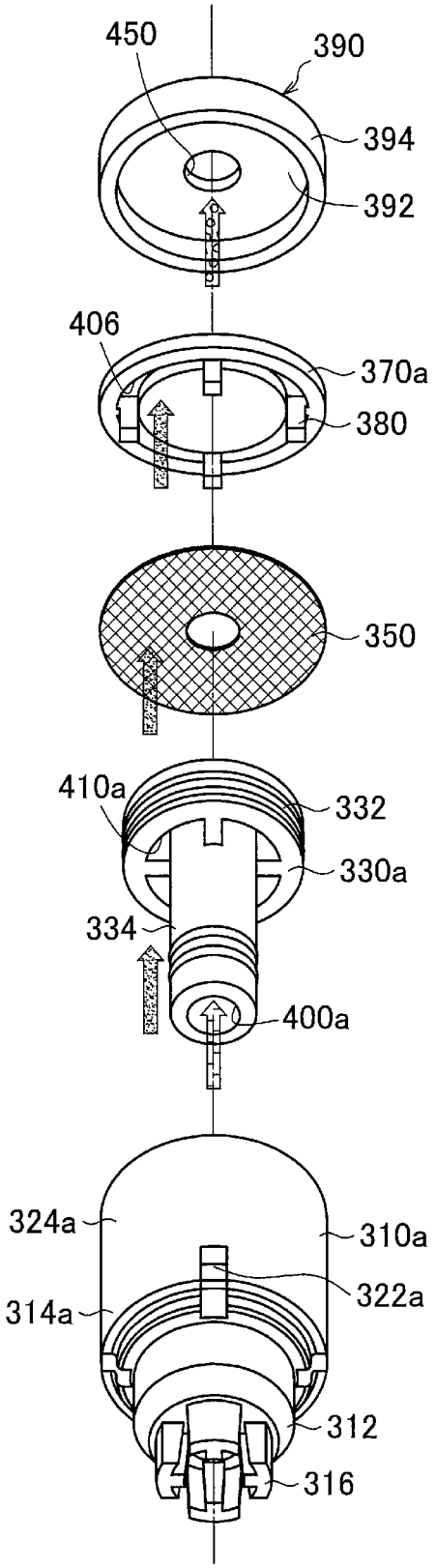
FIG. 13 is an exploded perspective view of the foamer mechanism 300*b* according to the embodiment.

As illustrated in FIGS. 12 and 13, the foamer mechanism 300*b* according to the present embodiment includes a combination of five members of, from below, the first member 310*a*, the second member 330*a*, the third member 350, the fourth member (contact member) 370*a*, and a fifth member 390. In other words, the foamer mechanism 300*b* includes the first member 310*a*, the second member 330*a*, the third member 350, the fourth member 370*a*, and the fifth member 390 stacked in this order. Note that in the present modification, the first member 310*a* to the fourth member 370*a* are similar to the respective members of the second embodiment described above; hence, detailed description of these members is omitted here, and only the fifth member 390 is described.

(Fifth Member 390)

As illustrated in FIGS. 12 and 13, the fifth member 390 according to the present embodiment is a disk-shaped member provided above the fourth member 370*a*. The fifth member 390 is disposed in a manner that its central axis exists on the same axis as the central axis of the fourth member 370*a*, and a lower end of an outer circumferential wall 394 described later of the fifth member 390 is in contact with an outer circumferential part of the fourth member 370*a*.

In detail, the fifth member 390 includes a disk-shaped bottom plate 392 provided horizontally inside its central part (a central part in planar view of the fifth member 390), and the outer circumferential wall 394 provided to surround an outer circumference of the bottom plate 392 and extending downward from a lower surface of the bottom plate 392. Furthermore, the central part of the bottom plate 392 is provided with a circular opening (flow channel) 450 that penetrates the bottom plate 392 along the vertical direction and communicates with the reserving chamber 440 between the fifth member 390 and the fourth member 370*a* and the discharge opening 242 of the nozzle 240 of the head 230 located above the fifth member 390. For example, as illustrated in FIG. 12, the circular opening 450 and the foamy liquid passages 406 are provided at different positions when viewed from the downstream side. By thus providing the fifth member 390 for dividing space between the discharge opening 242 and the reserving chamber 440, the fifth member 390 can hamper flow of foamed liquid, and foamed liquid can be reserved in the reserving chamber 440 for a longer time; hence, more suitable foamy liquid can presumably be obtained.

Third Embodiment

As described above, a foaming dispenser container according to an embodiment of the present invention is not limited to a pump-foamer-type container, and may be what is called a squeeze-foamer-type container that can make liquid foamy and discharge the foamy liquid by a container body being squeezed by the user. Hence, a foaming dispenser container 10*a*, which is a squeeze-foamer-type container, is described as a third embodiment of the present invention. The foaming dispenser container 10*a* also is a container capable of mixing liquid stored in a container body 100*a* described later with gas to make the liquid foamy, and discharging the foamy liquid to the outside of the foaming dispenser container 10*a*.

Figure 14:
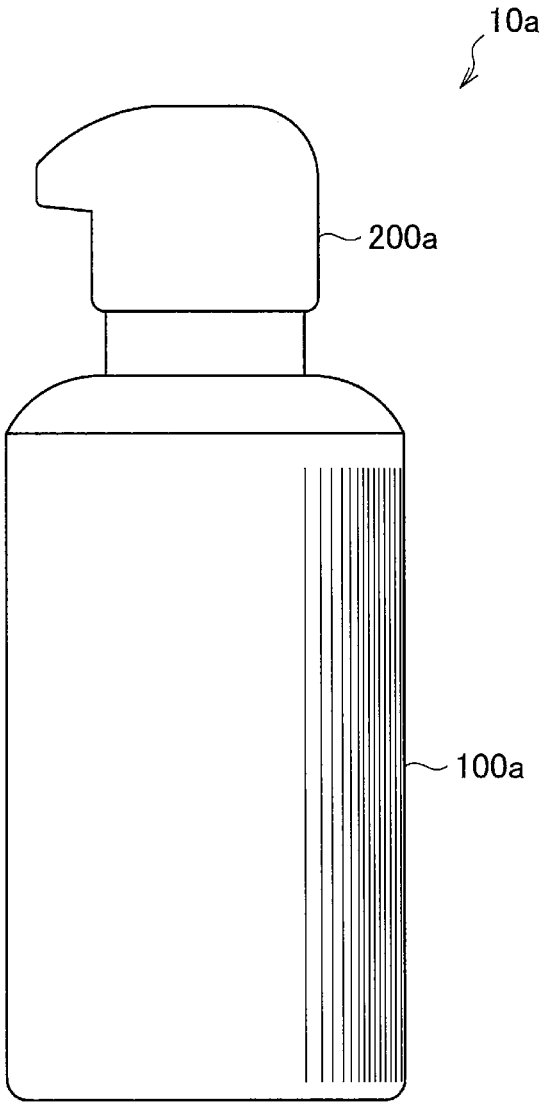
FIG. 14 is an explanatory diagram illustrating the appearance of a foaming dispenser container 10*a* according to a third embodiment of the present invention.
Figure 15:
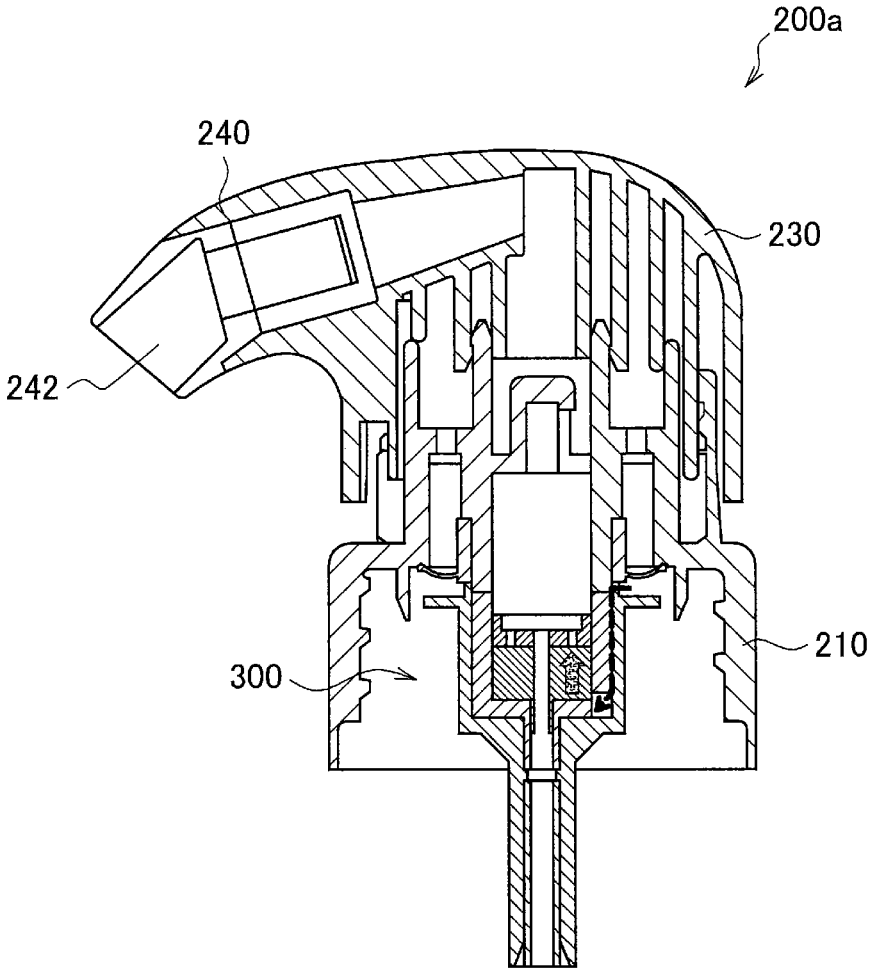
FIG. 15 is an explanatory diagram illustrating a side cross-section of a foaming dispenser cap 200*a* according to the embodiment.
Figure 16:
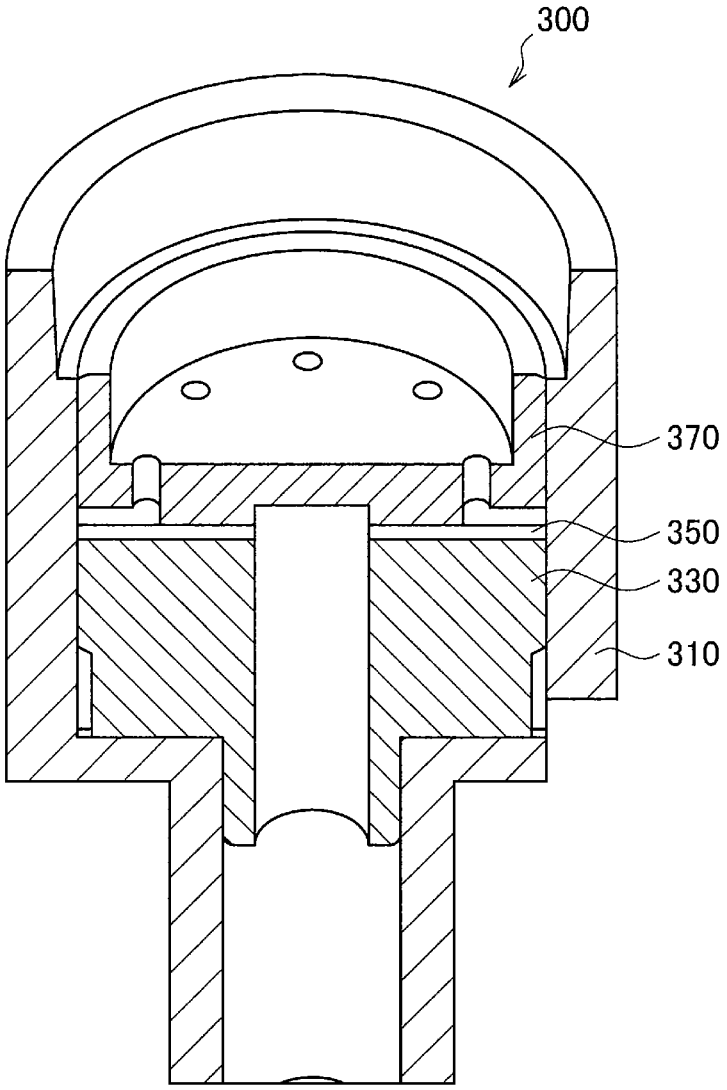
FIG. 16 is an explanatory diagram illustrating a perspective cross-section of the foamer mechanism 300 according to the embodiment.

A configuration of the foaming dispenser container 10*a* according to the present embodiment is described with reference to FIGS. 14 to 16. FIG. 14 is an explanatory diagram illustrating the appearance of the foaming dispenser container 10*a*. FIG. 15 is an explanatory diagram illustrating a side cross-section of a foaming dispenser cap 200*a* according to the present embodiment. Furthermore, FIG. 16 is an explanatory diagram illustrating a perspective cross-section of the foamer mechanism 300 according to the present embodiment.

As illustrated in FIG. 14, the foaming dispenser container 10*a* according to the present embodiment mainly includes the container body 100*a* in which liquid and gas are stored, and the foaming dispenser cap 200*a* that is detachably attached to the container body 100*a*. An overview of each part of the foaming dispenser container 10*a* is described below.

(Container Body 100*a*)

The container body 100*a* has a space capable of storing liquid and gas. A shape of the container body 100*a* is not particularly limited, but is preferably an elastically deformable, flexible container, because it is squeezed by the user's finger etc.

(Foaming Dispenser Cap 200*a*)

As illustrated in FIG. 14, the foaming dispenser cap 200*a* can be detachably attached to the container body 100*a* described above by a fixing method such as screwing. As illustrated in FIG. 15, the foaming dispenser cap 200*a* mainly includes the cap member 210 configured to be attached to the container body 100*a*, and the head 230 that is fixed to the cap member 210 and discharges foamy liquid to the outside of the foaming dispenser container 10*a*. Furthermore, the cap member 210 can include the foamer mechanism (mixing chamber) 300 according to the first embodiment of the present invention described above, as illustrated in FIG. 15. The foamer mechanism 300 according to the present embodiment has a configuration substantially similar to that of the foamer mechanism 300 according to the first embodiment, as illustrated in FIG. 16.

In the foaming dispenser container 10*a*, the container body 100*a* is squeezed by the user and a volume of an internal space contracts, so that pressure is applied to liquid and gas in the container body 100*a*; thus, the liquid and gas are supplied to the foamer mechanism 300. Furthermore, the foamer mechanism 300 to which liquid and gas are supplied mixes liquid and gas to generate foamy liquid, as in the embodiments described above.

In other words, the squeeze-foamer-type foaming dispenser container 10*a* achieves a function similar to that of the foaming dispenser cap (foaming dispenser) 200 of the pump-foamer-type foaming dispenser container 10, by incorporating the container body 100*a* into the function. In detail, the container body 100*a* according to the present embodiment can function as a liquid chamber, like the liquid pump chamber 280 of the pump-foamer-type foaming dispenser container 10, which stores liquid to be supplied to the foamer mechanism 300. In addition, the container body 100*a* can function as a gas chamber, like the gas pump chamber 260 of the pump-foamer-type foaming dispenser container 10, which stores gas to be supplied to the foamer mechanism 300. That is, the container body 100*a* is one space, but can function as both a liquid chamber and a gas chamber.

Note that in the present embodiment, the included foamer mechanism 300 is not limited to having a configuration similar to that of the foamer mechanism 300 according to the first embodiment, and may have a configuration similar to those of the foamer mechanisms 300*a* and 300*b* according to the second embodiment and its modification, for example.

<<Supplement>>

Components constituting the foaming dispenser containers according to the embodiments of the present invention described above are not particularly limited, but can be formed using any of various resin materials, for example. In addition, the foaming dispenser container 10 can be manufactured by any of known various types of molding etc.

The preferred embodiment(s) of the present invention has/have been described above with reference to the accompanying drawings, whilst the present invention is not limited to the above examples. A person skilled in the art may find various alterations and modifications within the scope of the appended claims, and it should be understood that they will naturally come under the technical scope of the present invention.

With respect to the above-described embodiment, the present invention further discloses the following aspects of the foaming dispenser or the foaming dispenser container.

<1> A foaming dispenser comprising:

a mixing chamber configured to mix a liquid and a gas to foam the liquid;

a first liquid passage configured to supply the liquid to the mixing chamber; and a discharge opening configured to discharge the foamed liquid, wherein the mixing chamber includes a plurality of second liquid passages branching and extending from the first liquid passage, a liquid passage meeting where one second liquid passage meets another second liquid passage, a gas passage configured to supply the gas to the liquid flowing from the plurality of second liquid passages to the liquid passage meeting, and a hole that is provided on a downstream side of the gas passage and communicates with the discharge opening.

<2> The foaming dispenser as set forth in clause <1>, wherein the gas passage communicates with the plurality of second liquid passages.

<3> The foaming dispenser according to clause <2>, further comprising a porous member located between the gas passage and the plurality of second liquid passages.

<4> The foaming dispenser as set forth in clause <3>, wherein the gas passage communicates with the plurality of second liquid passages at the liquid passage meeting.

<5> The foaming dispenser as set forth in clause <3> or <4>, wherein the plurality of second liquid passages are open on the gas passage side to communicate with the gas passage.

<6> The foaming dispenser as set forth in clause <5>, wherein liquid passage walls of the plurality of second liquid passages are in contact with a downstream side surface of the porous member, and the downstream side surface is provided on the downstream side of the gas passage.

<7> The foaming dispenser as set forth in any one of clauses <1> to <6>, wherein at the liquid passage meeting, the one second liquid passage meets the other second liquid passage in a manner that a direction of flow of the liquid in the one second liquid passage is opposite to a direction of flow of the liquid in the other second liquid passage.

<8> The foaming dispenser as set forth in any one of clauses <1> to <7>, wherein the plurality of second liquid passages extend in a plane where the plurality of second liquid passages meet the first liquid passage.

<9> The foaming dispenser as set forth in clause <8>, wherein each of the second liquid passages includes a first portion branching and extending radially from the first liquid passage in the plane, and a second portion bending and extending from the first portion in the plane.

<10> The foaming dispenser as set forth in clause <9>, wherein the second portion of the one second liquid passage and the second portion of the other second liquid passage meet each other, and thereby the second portions of the plurality of second liquid passages communicate with each other to constitute an annular liquid passage.

<11> The foaming dispenser as set forth in clause <10>, wherein the hole is open to the annular liquid passage.

<12> The foaming dispenser as set forth in clause <8>, wherein each of the second liquid passages includes a first portion branching and extending radially from the first liquid passage in the plane, and two second portions branching, bending, and extending from the first portion in the plane.

<13> The foaming dispenser as set forth in clause <12>, wherein in each of the second liquid passage, the two second portions have lengths equal to each other.

<14> The foaming dispenser as set forth in clause <13>, wherein in the plurality of second liquid passages, the second portions have lengths equal to each other.

<15> The foaming dispenser as set forth in clause <14>, wherein in the plurality of second liquid passages, the first portions have lengths equal to each other.

<16> The foaming dispenser as set forth in clause <14> or <15>, wherein the hole is open to a region where the second portion of the one second liquid passage and the second portion of the other second liquid passage meet each other.

<17> The foaming dispenser as set forth in clause <8>, wherein the gas passage meets the second liquid passage, and at a position where the gas passage meets the second liquid passage, the gas passage extends along a direction different from a direction in the plane.

<18> The foaming dispenser as set forth in clause <17>, wherein the gas passage extends along a direction in which the first liquid passage extends.

<19> The foaming dispenser as set forth in any one of clauses <1> to <18>, wherein the mixing chamber includes four or more second liquid passages.

<20> The foaming dispenser as set forth in any one of clauses <1> to <19>, further comprising:

a liquid chamber configured to reserve the liquid; and a gas chamber configured to reserve the gas.

<21> The foaming dispenser as set forth in clause <20>, further comprising:

a liquid supply unit configured to supply the liquid from the liquid chamber to the first liquid passage; and a gas supply unit configured to supply the gas from the gas chamber to the gas passage.

<22> The foaming dispenser as set forth in clause <21>, wherein the liquid supply unit is configured to apply pressure to the liquid in the liquid chamber to supply the liquid to the first liquid passage, and the gas supply unit is configured to apply pressure to the gas in the gas chamber to supply the gas to the gas passage.

<23> The foaming dispenser as set forth in clause <22>, further comprising a head movable in a vertical direction, wherein the liquid supply unit is configured to apply pressure to the liquid in the liquid chamber when the head is pushed down, and the gas supply unit is configured to apply pressure to the gas in the gas chamber when the head is pushed down.

<24> The foaming dispenser as set forth in clause <23>, wherein the head includes an operating part configured to be pushed down by a user.

<25> The foaming dispenser as set forth in clause <20>, wherein the liquid chamber and the gas chamber are different chambers.

<26> The foaming dispenser as set forth in clause <20>, wherein the liquid chamber and the gas chamber are a same chamber.

<27> A foaming dispenser container comprising:

the foaming dispenser as set forth in any one of clauses <1> to <24>; and a container body configured to store the liquid.

<28> The foaming dispenser container as set forth in clause <27>, further comprising the liquid stored in the container body.

<29> The foaming dispenser container as set forth in clause <28>, wherein the liquid includes at least one of powder, particles, and an additive.

<30> A foaming dispenser comprising:

a mixing chamber configured to mix a liquid and a gas to foam the liquid;

a first liquid passage configured to supply the liquid to the mixing chamber; and a discharge opening configured to discharge the foamed liquid, wherein the mixing chamber includes a plurality of second liquid passages branching and extending from the first liquid passage, and a gas passage configured to supply the gas by communicating with the plurality of second liquid passages via a porous member.

<31> The foaming dispenser as set forth in clause <30>, further comprising a hole that is provided on a downstream side of the gas passage and communicates with the discharge opening.

<32> The foaming dispenser as set forth in clause <30> or <31>, wherein the gas passage communicates with the plurality of second liquid passages.

<33> The foaming dispenser as set forth in clause <32>, wherein the plurality of second liquid passages are open on the gas passage side to communicate with the gas passage.

<34> The foaming dispenser as set forth in clause <33>, wherein liquid passage walls of the plurality of second liquid passages are in contact with a downstream side surface of the porous member, and the downstream side surface is provided on the downstream side of the gas passage.

<35> The foaming dispenser as set forth in any one of clauses <30> to <34>, wherein the plurality of second liquid passages extend in a plane where the plurality of second liquid passages meet the first liquid passage.

<36> The foaming dispenser as set forth in clause <35>, wherein each of the second liquid passage includes a first portion branching and extending radially from the first liquid passage in the plane, and a second portion bending and extending from the first portion in the plane.

<37> The foaming dispenser as set forth in clause <36>, wherein in the plurality of second liquid passages, the second portions have lengths equal to each other.

<38> The foaming dispenser as set forth in clause <37>, wherein in the plurality of second liquid passages, the first portions have lengths equal to each other.

<39> The foaming dispenser as set forth in clause <35>, wherein the gas passage meets the second liquid passage, and at a position where the gas passage meets the second liquid passage, the gas passage extends along a direction different from a direction in the plane.

<40> The foaming dispenser as set forth in clause <39>, wherein the gas passage extends along a direction in which the first liquid passage extends.

<41> The foaming dispenser as set forth in any one of clauses <30> to <40>, wherein the mixing chamber includes four or more second liquid passages.

<42> The foaming dispenser as set forth in any one of clauses <30> to <41>, further comprising:

a liquid chamber configured to reserve the liquid; and a gas chamber configured to reserve the gas.

<43> The foaming dispenser as set forth in clause <42>, further comprising:

a liquid supply unit configured to supply the liquid from the liquid chamber to the first liquid passage; and a gas supply unit configured to supply the gas from the gas chamber to the gas passage.

<44> The foaming dispenser as set forth in clause <43>, wherein the liquid supply unit is configured to apply pressure to the liquid in the liquid chamber to supply the liquid to the first liquid passage, and the gas supply unit is configured to apply pressure to the gas in the gas chamber to supply the gas to the gas passage.

<45> The foaming dispenser as set forth in clause <44>, further comprising a head movable in a vertical direction, wherein the liquid supply unit is configured to apply pressure to the liquid in the liquid chamber when the head is pushed down, and the gas supply unit is configured to apply pressure to the gas in the gas chamber when the head is pushed down.

<46> The foaming dispenser as set forth in clause <45>, wherein the head includes an operating part configured to be pushed down by a user.

<47> The foaming dispenser as set forth in clause <42>, wherein the liquid chamber and the gas chamber are different chambers.

<48> The foaming dispenser as set forth in clause <42>, wherein the liquid chamber and the gas chamber are a same chamber.

<49> A foaming dispenser container comprising:

the foaming dispenser as set forth in any one of clauses <30> to <46>; and a container body configured to store the liquid.

<50> The foaming dispenser container as set forth in clause <49>, further comprising the liquid stored in the container body.

<51> The foaming dispenser container as set forth in clause <50>, wherein the liquid includes at least one of powder, particles, and an additive.

<52> A foaming dispenser comprising:

a mixing chamber configured to mix a liquid and a gas to foam the liquid;

a first liquid passage configured to supply the liquid to the mixing chamber;

a gas passage configured to supply the gas to the mixing chamber by communicating with the mixing chamber via a porous member;

a contact member in contact with the porous member on a downstream side of the gas passage;

a reserving chamber configured to reserve the liquid foamed in the mixing chamber; and a discharge opening configured to discharge the foamed liquid from the reserving chamber, wherein the contact member includes a second liquid passage through which the mixing chamber and the reserving chamber communicate with each other.

<53> The foaming dispenser as set forth in clause <52>, further comprising a flow channel through which the reserving chamber and the discharge opening communicate with each other.

<54> The foaming dispenser as set forth in clause <52> or <53>, wherein the contact member includes a plurality of second liquid passages.

<55> The foaming dispenser as set forth in any one of clauses <52> to <54>, wherein the first liquid passage communicates with a center region of the mixing chamber to supply the liquid to the mixing chamber, and the gas passage communicates with a region of the mixing chamber surrounding the center region to supply the gas to the mixing chamber.

<56> The foaming dispenser according to any one of clauses <53> to <55>, wherein the reserving chamber is partitioned by a member on the downstream side of the mixing chamber to be formed on the downstream side of the mixing chamber, and the second liquid passage and the flow channel are provided at different positions when viewed from the downstream side.

<57> The foaming dispenser as set forth in any one of clauses <52> to <56>, wherein the second liquid passage is provided on the downstream side of the gas passage.

<58> The foaming dispenser as set forth in any one of clauses <52> to <57>, wherein the gas passage extends along a direction in which the first liquid passage extends.

<59> The foaming dispenser as set forth in any one of clauses <52> to <58>, further comprising:

a liquid chamber configured to reserve the liquid; and a gas chamber configured to reserve the gas.

<60> The foaming dispenser as set forth in clause <59>, further comprising:

a liquid supply unit configured to supply the liquid from the liquid chamber to the first liquid passage; and a gas supply unit configured to supply the gas from the gas chamber to the gas passage.

<61> The foaming dispenser as set forth in clause <60>, wherein the liquid supply unit is configured to apply pressure to the liquid in the liquid chamber to supply the liquid to the first liquid passage, and the gas supply unit is configured to apply pressure to the gas in the gas chamber to supply the gas to the gas passage.

<62> The foaming dispenser as set forth in clause <61>, further comprising a head movable in a vertical direction, wherein the liquid supply unit is configured to apply pressure to the liquid in the liquid chamber when the head is pushed down, and the gas supply unit is configured to apply pressure to the gas in the gas chamber when the head is pushed down.

<63> The foaming dispenser as set forth in clause <62>, wherein the head includes an operating part configured to be pushed down by a user.

<64> The foaming dispenser as set forth in clause <59>, wherein the liquid chamber and the gas chamber are different chambers.

<65> The foaming dispenser as set forth in clause <59>, wherein the liquid chamber and the gas chamber are a same chamber.

<66> A foaming dispenser container comprising:

the foaming dispenser as set forth in any one of clauses <52> to <61>; and a container body configured to store the liquid.

<67> The foaming dispenser container as set forth in clause <66>, further comprising the liquid stored in the container body.

<68> The foaming dispenser container as set forth in clause <67>, wherein the liquid includes at least one of powder, particles, and an additive.

REFERENCE SIGNS LIST

10,10*a* foaming dispenser container
100,100*a* container body
102 barrel
104 cylindrical neck
106 bottom
131 valve seat
131*a*,229 through hole
134 valve-constituting groove
155 suction valve member
180 ball valve
190 packing
200 foaming dispenser cap
210 cap member
212 attachment part
214 annular blocking part
216 standing tube
220 cylinder
221 gas cylinder mechanism
222 liquid cylinder mechanism
222*a* straight part
222*b* diameter-reduced part
223 annular coupling part
225 tube holding part
228 dip tube
230 head
232 operating part
233 flange
234,251 tubular part
234*a* outer tube
234*b* inner tube
240 nozzle
242 discharge opening
252 piston
253 outer circumferential ring
254 suction opening
260 gas pump chamber
270 liquid piston
272 coil spring
274 spring bearing
276 poppet
278 valve body
280 liquid pump chamber
290 piston guide
300,300*a*,300*b* foamer mechanism
310,310*a* first member
312,334 small diameter part
314,332 large diameter part
316 projection
318,372,392 bottom plate
320,420 axial through hole
322 axial groove
322*a*,450 opening
324,324*a*,328,374,394 outer circumferential wall
325,326,327 groove
330,330*a* second member
336 coupling part
350 third member
370,370*a* fourth member
376 liquid passage wall
380 leg
390 fifth member
400,400*a*,402 liquid passage
402*a* first portion
402*b* second portion
404 annular liquid passage
406 foamy liquid passage
410,410*a* gas passage
430 mixing chamber
440 reserving chamber

What is claimed is:

1. A foaming dispenser comprising:

a mixing chamber configured to mix a liquid and a gas to foam the liquid;

a first liquid passage configured to supply the liquid to the mixing chamber; and a discharge opening configured to discharge the foamed liquid, wherein the mixing chamber includes:

a plurality of second liquid passages branching and extending from the first liquid passage, a liquid passage meeting where one second liquid passage meets another second liquid passage, a gas passage configured to supply the gas to the liquid flowing from the plurality of second liquid passages to the liquid passage meeting, and a hole that is provided on a downstream side of the gas passage and communicates with the discharge opening, wherein a porous member is located between the gas passage and the plurality of second liquid passages, wherein the liquid is supplied to the first liquid passage and the second liquid passages without passing through the porous member, and wherein the gas supplied via the gas passage comes into contact with the liquid flowing through the second liquid passages, via the porous member.

2. The foaming dispenser according to claim 1, wherein the gas passage communicates with the plurality of second liquid passages.

3. The foaming dispenser according to claim 2, wherein the gas passage communicates with the plurality of second liquid passages at the liquid passage meeting.

4. The foaming dispenser according to claim 3, wherein the plurality of second liquid passages are open on the gas passage side to communicate with the gas passage.

5. The foaming dispenser according to claim 4, wherein liquid passage walls of the plurality of second liquid passages are in contact with a downstream side surface of the porous member, and the downstream side surface is provided on the downstream side of the gas passage.

6. The foaming dispenser according to claim 1, wherein at the liquid passage meeting, the one second liquid passage meets the other second liquid passage in a manner that a direction of flow of the liquid in the one second liquid passage is opposite to a direction of flow of the liquid in the other second liquid passage.

7. The foaming dispenser according to claim 1, wherein the plurality of second liquid passages extend in a plane where the plurality of second liquid passages meet the first liquid passage, and each of the second liquid passages includes;

a first portion branching and extending radially from the first liquid passage in the plane, and a second portion bending and extending from the first portion in the plane.

8. The foaming dispenser according to claim 7, wherein the second portion of the one second liquid passage and the second portion of the other second liquid passage meet each other, and thereby the second portions of the plurality of second liquid passages communicate with each other to constitute an annular liquid passage.

9. The foaming dispenser according to claim 8, wherein the hole is open to the annular liquid passage.

10. The foaming dispenser according to claim 1, wherein the plurality of second liquid passages extend in a plane where the plurality of second liquid passages meet the first liquid passage, the gas passage meets the second liquid passage, and at a position where the gas passage meets the second liquid passage, the gas passage extends along a direction different from a direction in the plane.

11. The foaming dispenser according to claim 1, further comprising:

a liquid chamber configured to reserve the liquid;

a gas chamber configured to reserve the gas;

a liquid supply unit configured to supply the liquid from the liquid chamber to the first liquid passage; and a gas supply unit configured to supply the gas from the gas chamber to the gas passage, wherein the liquid supply unit is configured to apply pressure to the liquid in the liquid chamber to supply the liquid to the first liquid passage, and the gas supply unit is configured to apply pressure to the gas in the gas chamber to supply the gas to the gas passage.

12. The foaming dispenser according to claim 11, further comprising a head movable in a vertical direction, wherein the liquid supply unit is configured to apply pressure to the liquid in the liquid chamber when the head is pushed down, and the gas supply unit is configured to apply pressure to the gas in the gas chamber when the head is pushed down.

13. A foaming dispenser comprising:

a mixing chamber configured to mix a liquid and a gas to foam the liquid;

a first liquid passage configured to supply the liquid to the mixing chamber; and a discharge opening configured to discharge the foamed liquid, wherein the mixing chamber includes:

a plurality of second liquid passages branching and extending from the first liquid passage, and a gas passage configured to supply the gas by communicating with the plurality of second liquid passages via a porous member, wherein the porous member is located between the gas passage and the plurality of second liquid passages, wherein the liquid is supplied to the first liquid passage and the second liquid passages without passing through the porous member, and wherein the gas supplied via the gas passage comes into contact with the liquid flowing from the second liquid passages, via the porous member.

14. The foaming dispenser according to claim 13, further comprising a hole that is provided on a downstream side of the gas passage and communicates with the discharge opening.

15. The foaming dispenser according to claim 14, wherein the gas passage communicates with the plurality of second liquid passages, and the plurality of second liquid passages are open on the gas passage side to communicate with the gas passage.

16. The foaming dispenser according to claim 15, wherein liquid passage walls of the plurality of second liquid passages are in contact with a downstream side surface of the porous member, and the downstream side surface is provided on the downstream side of the gas passage.

* * * * *